US012655978B1

(12) United States Patent
Eilers et al.

(10) Patent No.: US 12,655,978 B1
(45) Date of Patent: Jun. 16, 2026

(54) HELMHOLTZ DAMPER SYSTEM FOR COMBUSTOR OF GAS TURBINE SYSTEM AND RELATED COMBUSTOR AND FUEL NOZZLE ASSEMBLY

(71) Applicant: GE Vernova Infrastructure Technology LLC, Greenville, SC (US)

(72) Inventors: Bridget Eilers, Greenville, SC (US); Benjamin Crawford Eisman, Greenville, SC (US); Tyler Walton Kasperski, Greer, SC (US); Michael Joseph Jordan, Anderson, SC (US); Layal Hakim, Würenlos (CH)

(73) Assignee: GE Vernova Infrastructure Technology LLC, Greenville, SC (US)

( * ) Notice: Subject to any disclaimer, the term of this patent is extended or adjusted under 35 U.S.C. 154(b) by 0 days.

(21) Appl. No.: 19/247,619

(22) Filed: Jun. 24, 2025

(51) Int. Cl.
*F23R 3/60* (2006.01)
*F23R 3/28* (2006.01)
*F23R 3/00* (2006.01)

(52) U.S. Cl.
CPC ..... *F23R 3/283* (2013.01); *F23R 3/002* (2013.01); *F23R 3/60* (2013.01); *F23R 2900/00014* (2013.01)

(58) Field of Classification Search
CPC .. F23R 3/002; F23R 3/283; F23R 3/60; F23R 2900/00014; F05D 2270/14; F05D 2260/96; F05D 2260/963; F05D 2260/964
See application file for complete search history.

(56) References Cited

U.S. PATENT DOCUMENTS

| | | | | |
|---|---|---|---|---|
| 6,351,947 | B1 * | 3/2002 | Keller | F23M 20/005 60/725 |
| 6,464,489 | B1 * | 10/2002 | Gutmark | F02B 51/06 60/725 |
| 6,530,221 | B1 * | 3/2003 | Sattinger | F23M 20/005 60/725 |
| 7,661,267 | B2 * | 2/2010 | Pollarolo | F23M 20/005 60/725 |
| 8,943,825 | B2 | 2/2015 | Magni et al. | |
| 8,966,903 | B2 | 3/2015 | Bobba et al. | |
| 8,973,365 | B2 | 3/2015 | Corr et al. | |
| 9,988,958 | B2 | 6/2018 | You et al. | |
| 10,473,328 | B2 | 11/2019 | Schilp et al. | |
| 11,041,625 | B2 | 6/2021 | Purcell et al. | |
| 11,131,456 | B2 | 9/2021 | Dyszkiewicz et al. | |

(Continued)

*Primary Examiner* — William H Rodriguez
(74) *Attorney, Agent, or Firm* — James Pemrick; Charlotte Wilson; Hoffman Warnick LLC

(57) ABSTRACT

A Helmholtz damper system includes damper element(s) that include a tube positioned in a hollow mount in a cap assembly of a combustor. The hollow mount has an aft end in fluid communication with a combustion chamber. The tube has a hollow body having an aft end in fluid communication with the combustion chamber, a forward end, and a volume therein. A damping volume control member is coupled to the tube and has a perforated member positioned to at least partially define a damping volume. The damping volume may be defined between the perforated member and another perforated member at the aft end of the tube or just within the control member. The damping volume controls a frequency dampened by the damper element and can be adjusted to the exact frequency requiring damping by adjusting the control member size and/or shape.

24 Claims, 13 Drawing Sheets

(56) References Cited

U.S. PATENT DOCUMENTS

| | | | | |
|---|---|---|---|---|
| 12,134,986 | B1 * | 11/2024 | Nath | F02C 7/24 |
| 12,379,108 | B2 * | 8/2025 | Hughes | F23R 3/346 |
| 2005/0034918 | A1 * | 2/2005 | Bland | F23M 20/005 181/266 |
| 2007/0169992 | A1 * | 7/2007 | Wasif | F23M 20/005 181/293 |
| 2008/0216481 | A1 * | 9/2008 | Pollarolo | F23M 20/005 60/725 |
| 2013/0037345 | A1 * | 2/2013 | Wang | F02C 7/24 181/204 |
| 2015/0096829 | A1 * | 4/2015 | Bothien | F23R 3/16 181/204 |
| 2016/0153661 | A1 * | 6/2016 | Bothien | F23R 3/16 60/725 |
| 2017/0268777 | A1 | 9/2017 | Hase et al. | |
| 2018/0313540 | A1 * | 11/2018 | Nagaraja | F23R 3/286 |
| 2022/0373180 | A1 * | 11/2022 | Akamatsu | F23R 3/005 |
| 2023/0104922 | A1 * | 4/2023 | Berry | F28F 13/12 60/730 |
| 2023/0366547 | A1 * | 11/2023 | Nath | F23R 3/002 |
| 2023/0400185 | A1 | 12/2023 | Burbaum | |
| 2024/0230098 | A1 * | 7/2024 | Berry | F23R 3/002 |

* cited by examiner

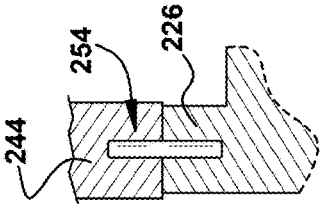
FIG. 9
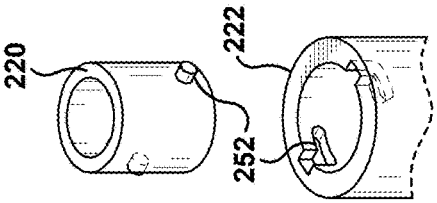
FIG. 8
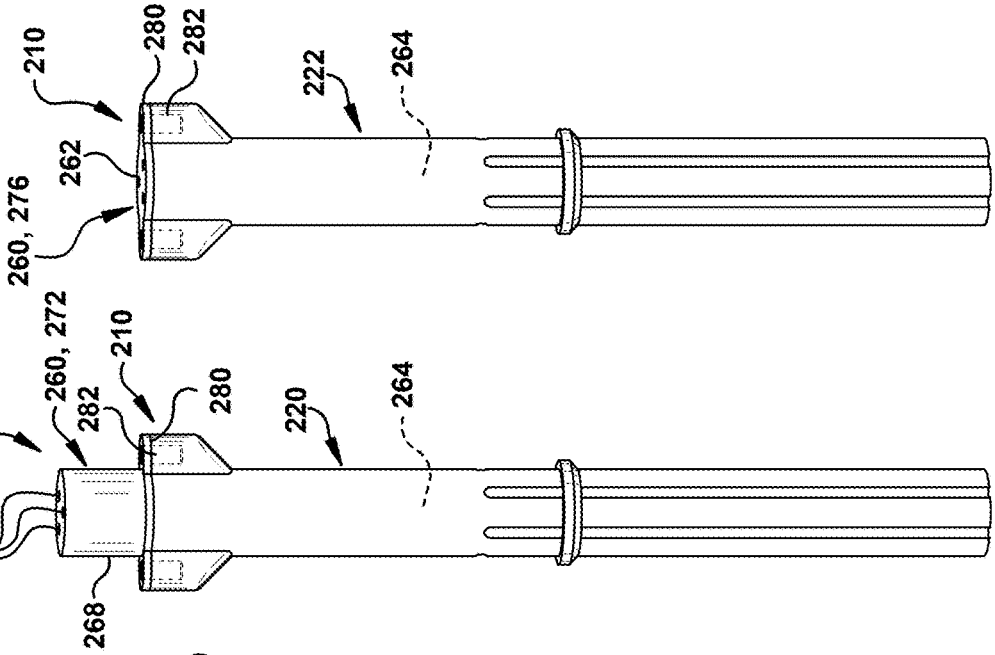
FIG. 10E
FIG. 10D
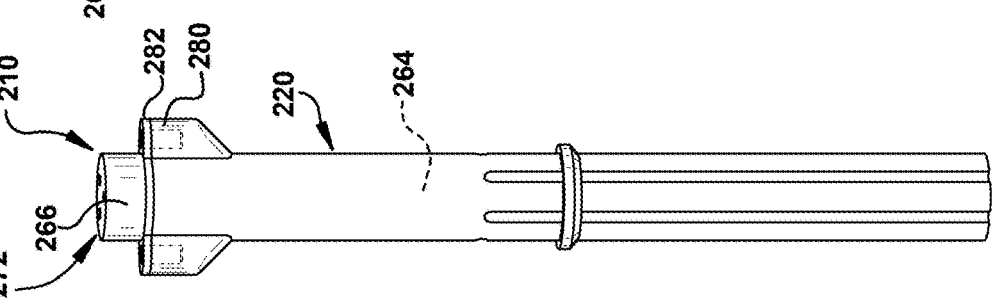
FIG. 10C
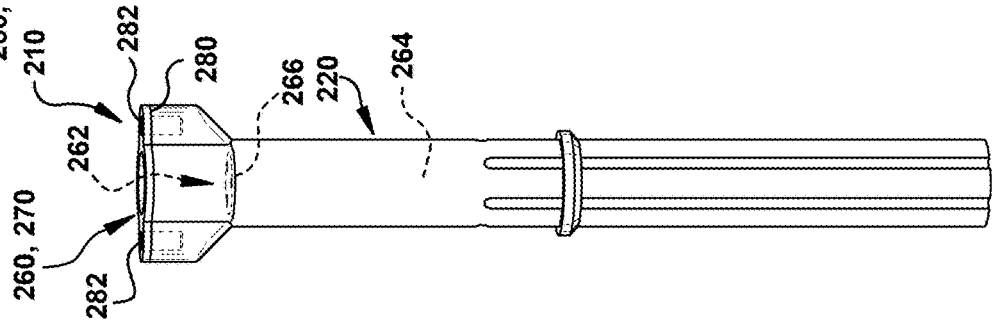
FIG. 10B
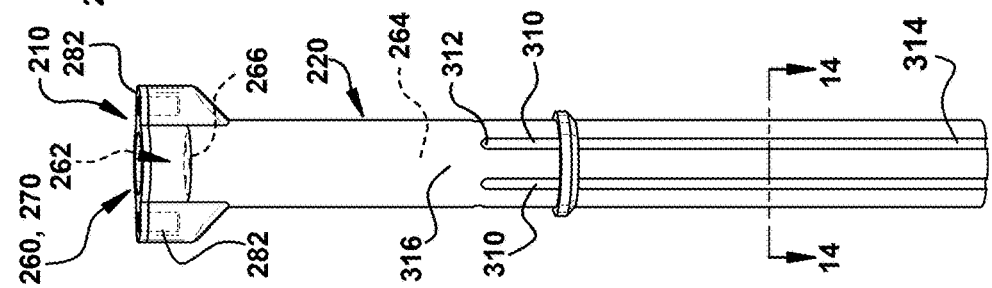
FIG. 10A

HELMHOLTZ DAMPER SYSTEM FOR COMBUSTOR OF GAS TURBINE SYSTEM AND RELATED COMBUSTOR AND FUEL NOZZLE ASSEMBLY

TECHNICAL FIELD

The disclosure relates generally to vibration damping in combustors of gas turbine systems. More specifically, the disclosure relates to a highly customizable Helmholtz damper system for a combustor of a gas turbine system and a related combustor and fuel nozzle assembly.

BACKGROUND

Particular combustion systems for gas turbine systems use combustors, which burn a gaseous or liquid fuel mixed with compressed air. Generally, a combustor includes a fuel nozzle assembly including multiple fuel nozzles that provide a mixture of fuel and compressed air to a primary combustion zone or chamber. A combustor may have bundled tube fuel nozzles (also known as micromixer fuel nozzles) for premixing a fuel with compressed air in a plurality of premixing tubes upstream from the combustion zone. A fuel nozzle assembly, including the premixing tubes arranged in one or more fuel nozzles, is at least partially defined by a cap assembly including, for example, a forward plate, an aft plate, and an outer sleeve. Compressed air flows into an inlet portion of each premixing tube. Fuel from, for example, a fuel plenum is injected into each premixing tube where it premixes with the compressed air before it is routed into the combustion zone.

During operation, various operating parameters such as fuel temperature, fuel composition, ambient operating conditions, and/or operational load on the gas turbine system may result in combustion dynamics or pressure pulses within the combustor. The combustion dynamics may cause oscillation of various combustor hardware components such as the liner and/or the fuel nozzles, which may result in undesirable wear of those components. Alternatively, or in addition, high frequencies of combustion dynamics may produce pressure pulses inside the fuel nozzles (e.g., premixing tubes of micromixer-type fuel nozzles) and/or combustion chamber that affect the stability of the combustion flame, reduce the design margins for flashback or flame holding, and/or increase undesirable emissions. The dynamics are typically addressed using vibration dampers such as quarter wave dampers or Helmholtz dampers. However, precisely addressing the complete range of frequencies of the vibrations can be very challenging.

BRIEF DESCRIPTION

All aspects, examples and features mentioned below can be combined in any technically possible way.

An aspect of the disclosure provides a Helmholtz damper system for a combustor of a gas turbine system, the Helmholtz damper system comprising: at least one damper element in a cap assembly of the combustor, each damper element including: a tube configured to be positioned in a hollow mount in the cap assembly of the combustor, wherein the hollow mount has a mount aft end in fluid communication with a combustion chamber of the combustor and a mount forward end opposing the aft end, wherein the tube has a hollow body having an aft end having a first perforated member in fluid communication with the combustion chamber, a forward end opposite the aft end, and a volume between the aft end and the forward end; and a damping volume control member coupled to the tube and having a second perforated member positioned to selectively define a damping volume from the volume of the tube, the damping volume defined between the second perforated member and the aft end of the hollow body of the tube, wherein the damping volume controls a frequency dampened by the respective damper element.

Another aspect of the disclosure includes any of the preceding aspects, and the damping volume control member includes a tubular insert configured to be positioned in the forward end of the tube to define the damping volume by reducing the volume of the tube and to increase a damping frequency of the respective damper element, wherein the second perforated member is disposed between the forward and aft ends of the tube.

Another aspect of the disclosure includes any of the preceding aspects, and the tube has a perforated divider member between the aft end and the forward end dividing the damping volume into a forward damping volume between the second perforated member of the damping volume control member and the perforated divider member and an aft damping volume between the perforated divider member and the first perforated member of the tube.

Another aspect of the disclosure includes any of the preceding aspects, and at least a portion of the tubular insert and at least a portion of the forward end of the tube have mating threaded surfaces, wherein the tubular insert is threadedly connected in at least the forward end of the tube.

Another aspect of the disclosure includes any of the preceding aspects, and the damping volume control member includes an externally threaded surface configured to threadedly connect in an internally threaded surface in the tube.

Another aspect of the disclosure includes any of the preceding aspects, and wherein the forward end of the tube is aft of the forward end of the hollow mount.

Another aspect of the disclosure includes any of the preceding aspects, and the damping volume control member includes a volume enlarging member configured to be positioned at the forward end of the tube to define the damping volume by increasing the volume of the tube and to decrease a damping frequency of the respective damper element, wherein the second perforated member is disposed forward of the forward end of the tube.

Another aspect of the disclosure includes any of the preceding aspects, and further comprising a damping weight positioned in the aft end of the tube.

Another aspect of the disclosure includes any of the preceding aspects, and the second perforated member of the damping volume control member fluidly couples the damping volume and an air plenum defined forward of the cap assembly.

Another aspect of the disclosure includes any of the preceding aspects, and the tube includes an external positioning member between the aft end and the forward end thereof, the external positioning member interacting with the forward end of the hollow mount to position the tube relative to the hollow mount.

Another aspect of the disclosure includes any of the preceding aspects, and further comprising a plurality of cooling passages defined at least partially longitudinally in the tube, each cooling passage having an inlet in fluid communication with an air plenum defined forward of the cap assembly and an outlet in fluid communication with the combustion chamber.

Another aspect of the disclosure includes any of the preceding aspects, and at least one of the plurality of cooling passages includes a length extending radially inward toward a center of the tube, and wherein the damping volume control member includes a tubular insert configured to be positioned in the forward end of the tube, and wherein the tubular insert includes a recess in an exterior surface thereof to receive the length of the at least one of the plurality of cooling passages.

Another aspect of the disclosure includes any of the preceding aspects, and the first perforated member of the tube includes a plurality of cooling members extending from an inner surface toward a center of the tube at the aft end thereof, each cooling member including a portion of a respective cooling passage defined therein and the outlet of the respective cooling passage directed into the combustion chamber.

Another aspect of the disclosure includes any of the preceding aspects, and the outlet of each cooling passage is directed radially outwardly from the tube.

Another aspect of the disclosure includes any of the preceding aspects, and wherein the damping volume control member is additively manufactured.

Another aspect of the disclosure includes any of the preceding aspects, and the damping volume control member is removably fastened to at least the tube with at least one of a threaded fastener, a threaded joint, a weld, a twist-lock mechanism, or a pinned connection.

Another aspect of the disclosure includes any of the preceding aspects, and the tube is removably fastened to the hollow mount with at least one of a threaded fastener, a threaded joint, a weld, a twist-lock mechanism, or a pinned connection.

Another aspect of the disclosure includes a fuel nozzle assembly including the Helmholtz damper system of any of the preceding aspects, wherein the cap assembly includes a plurality of premixing tubes positioned adjacent the hollow mount of the at least one damper element.

Another aspect of the disclosure includes a combustor including the fuel nozzle assembly of the preceding aspect and the combustion chamber downstream of the fuel nozzle assembly.

Another aspect of the disclosure includes a Helmholtz damper system for a combustor of a gas turbine system, the Helmholtz damper system comprising: at least one damper element in a cap assembly of the combustor, each damper element including: a tube configured to be positioned in a hollow mount in a cap assembly of the combustor, wherein the hollow mount has an aft end in fluid communication with a combustion chamber of the combustor and a forward end opposing the aft end, wherein the tube has a hollow body having an aft end in fluid communication with the combustion chamber, a forward end opposite the aft end, and a volume between the aft end and the forward end; and a damping volume control member having a tubular body coupled to and extending at least a length of the tube, the damping volume control member further having a first perforated member positioned at an aft end of the tubular body and within the tube and a second perforated member positioned forward of the first perforated member to selectively define a damping volume between the first and second perforated members, wherein the damping volume controls a frequency dampened by the respective damper element.

Another aspect of the disclosure includes any of the preceding aspects, and the second perforated member is positioned aft of the forward end of the tube, and the damping volume is between the forward and aft ends of the tube.

Another aspect of the disclosure includes any of the preceding aspects, and the second perforated member is positioned forward of the forward end of the tube, and the damping volume is partially between the forward and aft ends of the tube and partially forward of the forward end of the tube.

Another aspect of the disclosure includes a fuel nozzle assembly including the Helmholtz damper system of any of the preceding aspects, wherein the cap assembly includes a plurality of premixing tubes positioned adjacent the hollow mount of at least one damper element.

Another aspect of the disclosure includes a combustor including the fuel nozzle assembly of the preceding aspect and the combustion chamber downstream of the fuel nozzle assembly.

Two or more aspects described in this disclosure, including those described in this summary section, may be combined to form implementations not specifically described herein. That is, all embodiments described herein can be combined with each other.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which:

FIG. 8 shows a cross-sectional view of a damper element of a Helmholtz damper system, according to further embodiments of the disclosure;

FIG. 9 shows a cross-sectional view of a damper element of a Helmholtz damper system, according to other embodiments of the disclosure;

FIGS. 10A-E show perspective views of damper elements (apart from a cap assembly) having different damping volume control members thereon to provide different damping frequencies, according to embodiments of the disclosure;

Figure 1:
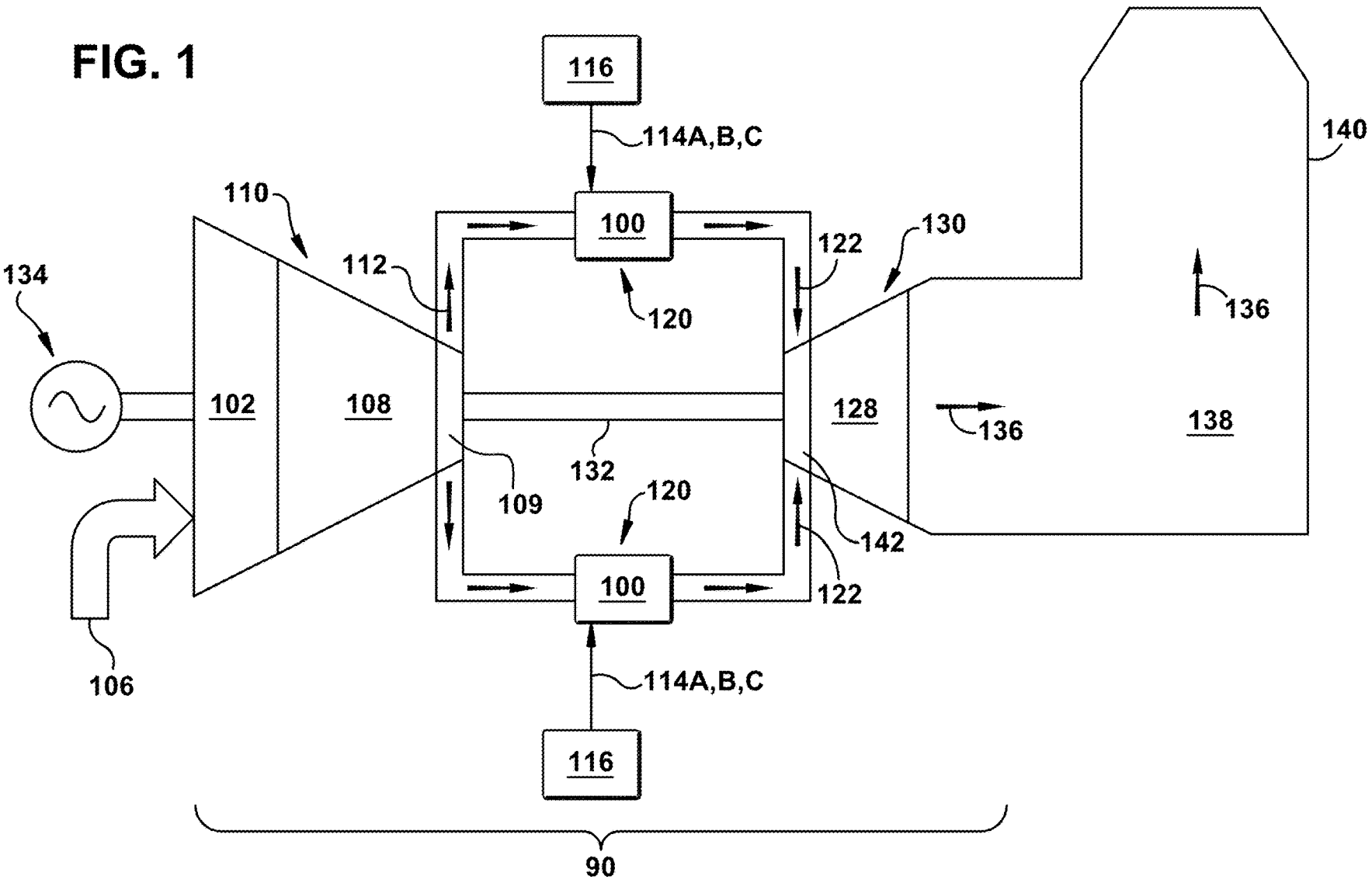
FIG. 1 shows a functional block diagram of an illustrative gas turbine system capable of use with a combustor including a Helmholtz damper system, according to embodiments of the disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the current disclosure, it will become necessary to select certain terminology when referring to and describing relevant machine components within the illustrative application of a combustor for a gas turbine system and related Helmholtz damper system therefor. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used herein, and it should prove helpful to define these terms at the onset of this section. These terms and their definitions, unless stated otherwise, are as follows. As used herein, "downstream" and "upstream" are terms that indicate a direction relative to the flow of a fluid, such as the working fluid through a combustor of the turbomachine or, for example, the flow of air or fuel through the combustor or parts thereof like fuel nozzles or a cap assembly, etc., or coolant through one of the turbomachine's component systems. The term "downstream" corresponds to the direction of flow of the fluid, and the term "upstream" refers to the direction opposite to the flow. The terms "forward" and "aft," without any further specificity, refer to directions, with "forward" referring to the front or compressor end of the turbomachine or combustor, and "aft" referring to the rearward or turbine end of the turbomachine or combustor.

The term "axial" refers to movement or position parallel to an axis, e.g., an axis of a damper element, a combustor, or a gas turbine. The term "radial" refers to movement or position perpendicular to an axis, e.g., an axis of a damper element, a combustor, or a gas turbine. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. Finally, the term "circumferential" refers to movement or position around an axis, e.g., a circumferential interior surface of a combustor body or a circumferential interior of casing extending about a combustor. As indicated above, and depending on context, it will be appreciated that such terms may be applied in relation to the axis of, for example, a damper element, a combustor, or a turbine.

In addition, several descriptive terms may be used regularly herein, as described below. The terms "first," "second," and "third," may be used interchangeably to distinguish one component from another and are not intended to signify location or importance of the individual components.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event may or may not occur or that the subsequently described feature may or may not be present and that the description includes instances where the event occurs, or the feature is present and instances where the event does not occur, or the feature is not present.

Where an element or layer is referred to as being "on," "engaged to," "connected to," "coupled to," or "mounted to" another element or layer, it may be directly on, engaged, connected, coupled, or mounted to the other element or layer, or intervening elements or layers may be present. In contrast, when an element is referred to as being "directly on," "directly engaged to," "directly connected to," or "directly coupled to" another element or layer, there are no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items. The verb forms of "couple" and "mount" may be used interchangeably herein.

Embodiments of the disclosure provide a Helmholtz damper system for a combustor of a gas turbine system, and a combustor and a fuel nozzle assembly including the Helmholtz damper system. The Helmholtz damper or resonator system includes at least one damper element in a cap assembly of the combustor. Each damper element includes a tube configured to be positioned in a hollow mount in the cap assembly. The hollow mount has a mount aft end in fluid communication with a combustion chamber of the combustor and a mount forward end opposing the mount aft end. The tube has a hollow body having an aft end that may include a first perforated member in fluid communication with the combustion chamber, a forward end opposite the aft end, and a volume between the aft end and the forward end. The damper element(s) also include a damping volume control member coupled to the tube and having a second perforated member positioned to selectively define a damping volume from the volume of the tube. The damping volume may be defined between the second perforated member and the first perforated member at the aft end of the tube. Alternatively, the damping volume may be defined within the control member. In any event, the damping volume controls a frequency dampened by the damper element.

The damper elements can be precisely adjusted to the exact frequency requiring damping by adjusting, as will be more fully described herein, which damping volume control member is used. The damper element(s) allow adjustment to address frequency(ies) that may not be initially known and may be broadband. The damper element(s) also allow minor and/or incremental adjustment of the damping frequency, allowing for precise frequencies to be targeted. The removable nature of the parts of the damper element(s) allow them to be taken on and off between tests without having to manufacture entirely new resonators, and without changing a cross-sectional area of the damper elements or mating parts of the fuel nozzle assembly or the cap assembly.

FIG. 1 shows a functional block diagram of an illustrative gas turbine system (GT) system 90 that may incorporate various embodiments of a combustor 100 and a Helmholtz damper system 200 (FIG. 2-4) of the present disclosure. As shown, GT system 90 generally includes an inlet section 102 that may include, for example, a series of filters, cooling coils, moisture separators, and/or other devices to purify and otherwise condition air 106 entering GT system 90. Air 106 flows to a compressor 108 in a compressor section 110 that progressively imparts kinetic energy to air 106 to produce a compressed, high-pressure (HP) air 112 (alternately "HP air 112" or "compressed air 112" hereafter) at a highly energized state. HP air 112 is typically mixed with one or more fuels, e.g., fuel 114A, fuel 114B and/or fuel 114C, from a fuel source(s) 116 to form a combustible mixture within at least one combustor 100 in a combustion section 120 that is operatively coupled to compressor section 110. Fuels 114A-C may include but are not limited to natural gas, fuel oil, hydrogen and ammonia. The combustible mixture ignites to produce combustion gases 122 having a high temperature and pressure.

Combustion gases 122 flow through a turbine 128 (e.g., an expansion turbine) of a turbine section 130 operatively coupled to combustion section 120 to produce work. For example, turbine 128 may be connected to a shaft 132 so that rotation of turbine 128 drives compressor 108 to produce HP air 112. Alternatively, or in addition, shaft 132 may connect turbine 128 to another load, such as a generator 134 for producing electricity. Exhaust gases 136 from turbine 128 flow through an exhaust section 138 that connects turbine 128 to an exhaust stack 140 downstream from turbine 128. Exhaust section 138 may include, for example, a heat recovery steam generator ("HRSG," not shown) for cleaning and extracting additional heat from exhaust gases 136 before release to the environment. Where more than one combustor 100 is used, they may be circumferentially spaced around a turbine inlet 142 of turbine 128.

In one embodiment, GT system 90 may be applicable to an engine model commercially available from GE Vernova of Cambridge, MA including, for example, any HA, F, B, LM, GT, TM, and E-class engine models. The present disclosure is not limited to any one particular GT system and may be implemented in connection with other turbine engines or engine models of other companies. Furthermore, the present disclosure is not limited to any particular turbomachine, and may be applicable to, for example, steam turbines, jet engines, compressors, turbofans, etc.

Figure 2:
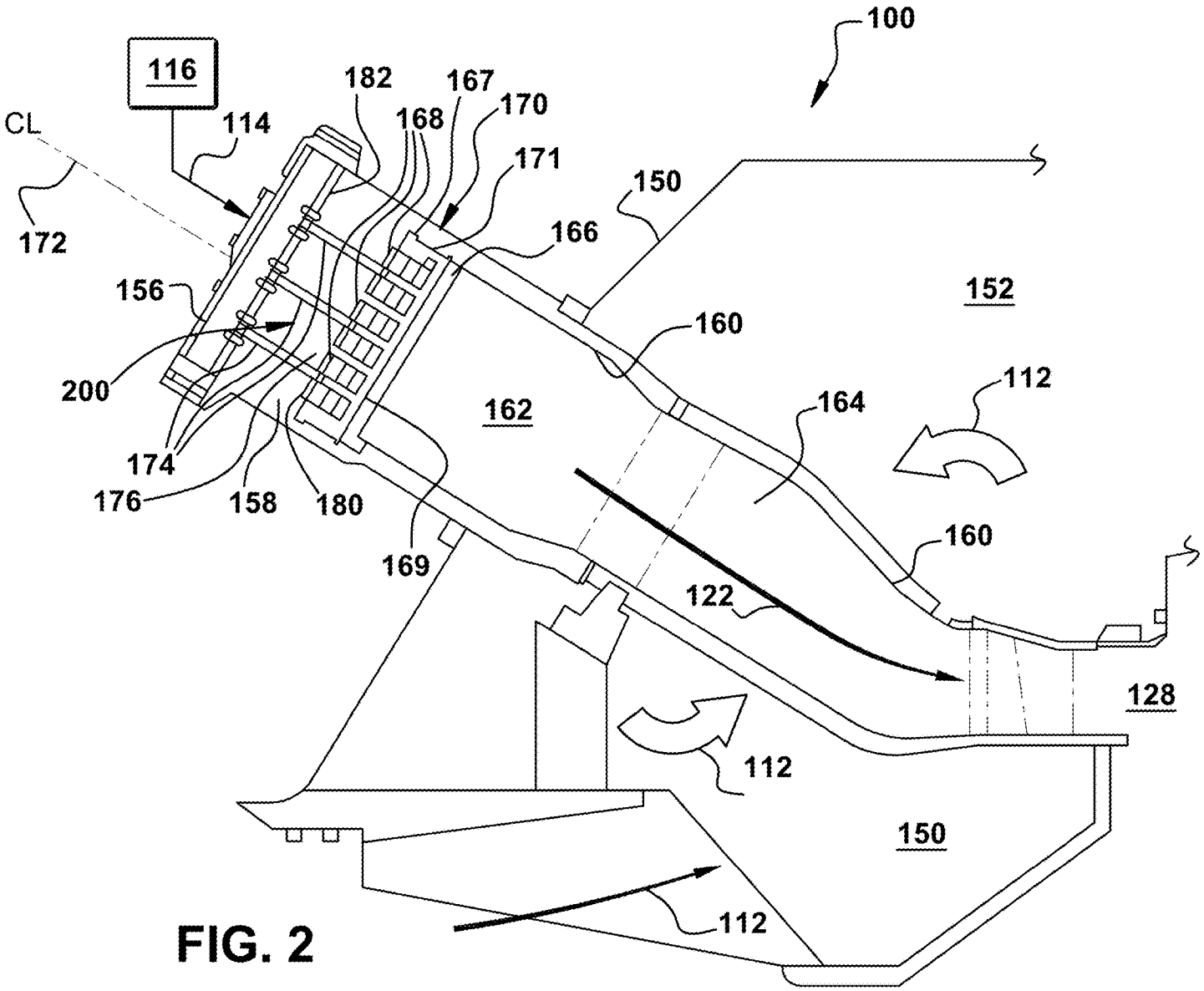
FIG. 2 shows a cross-sectional side view of a combustor including a Helmholtz damper system, according to embodiments of the disclosure.

An illustrative combustor 100 usable within GT system 90 will now be described. FIG. 2 shows a cross-sectional side view of an illustrative combustor 100 positioned within GT system 90 (FIG. 1). As will be further described herein, combustor 100 may include a Helmholtz damper system 200 according to embodiments of the disclosure. While an illustrative combustor 100 will be described herein, it is emphasized that Helmholtz damper system 200 according to embodiments of the disclosure may be used in a large variety of different types of combustors 100. Hence, the teachings of the disclosure are not limited to any particular combustor.

As shown in FIG. 2, combustor 100 may be at least partially surrounded by an outer casing 150 such as a compressor discharge casing. Outer casing 150 may at least partially define a high pressure plenum 152 that at least partially surrounds various components of combustor 100. High pressure plenum 152 may be in fluid communication with compressor 108 (FIG. 1) so as to receive compressed air 112 therefrom. An end cover 156 may be coupled to a forward portion of outer casing 150. In certain embodiments, outer casing 150 and end cover 156 may at least partially define a head end volume or portion 158 of combustor 100.

In certain embodiments, head end portion 158 is in fluid communication with high pressure plenum 152 and/or compressor 108 (FIG. 1). One or more liners or ducts 160 may at least partially define a combustion chamber or zone 162 for combusting the fuel-air mixture and/or may at least partially define a hot gas path 164 through combustor 100 for directing combustion gases 122 towards an inlet to turbine 128.

In various embodiments, combustor 100 includes a cap assembly 166 including a plurality of fuel nozzles defined as a bundle of premixing tubes 168, the fuel nozzles collectively forming a fuel nozzle assembly 170. As shown in FIG. 2, fuel nozzle assembly 170 is disposed within outer casing 150 downstream from and/or axially spaced from end cover 156 with respect to axial centerline 172 of combustor 100 and upstream from combustion chamber 162. In particular embodiments, fuel nozzle assembly 170 is in fluid communication with a fuel supply 116 via one or more fluid conduits 174. In certain embodiments, fluid conduit(s) 174 may be fluidly coupled and/or connected at one end to or through end cover 156. It should be understood that fuel nozzle assembly 170 and/or fluid conduit(s) 174 may be mounted to structures other than end cover 156 (e.g., the outer casing 150). Compressed air 112 from high pressure plenum 152 may be routed to an air plenum 176 upstream of fuel nozzle assembly 170, e.g., between a forward end 180 of cap assembly 166 and an aft end 182 of end cover 156. Fuel(s) 114A-C may be routed to fuel nozzles 168 through end cover 156 in any now known or later developed manner, e.g., fluid conduit(s) 174 or other mechanisms. Fuel nozzles 168 may take any now known or later developed form such as but not limited to tube fuel nozzles or micromixers. As illustrated, a plurality of fuel nozzles 168 are formed from pluralities of premixing tubes that are arranged/bundled in cap assembly 166.

Figure 3:
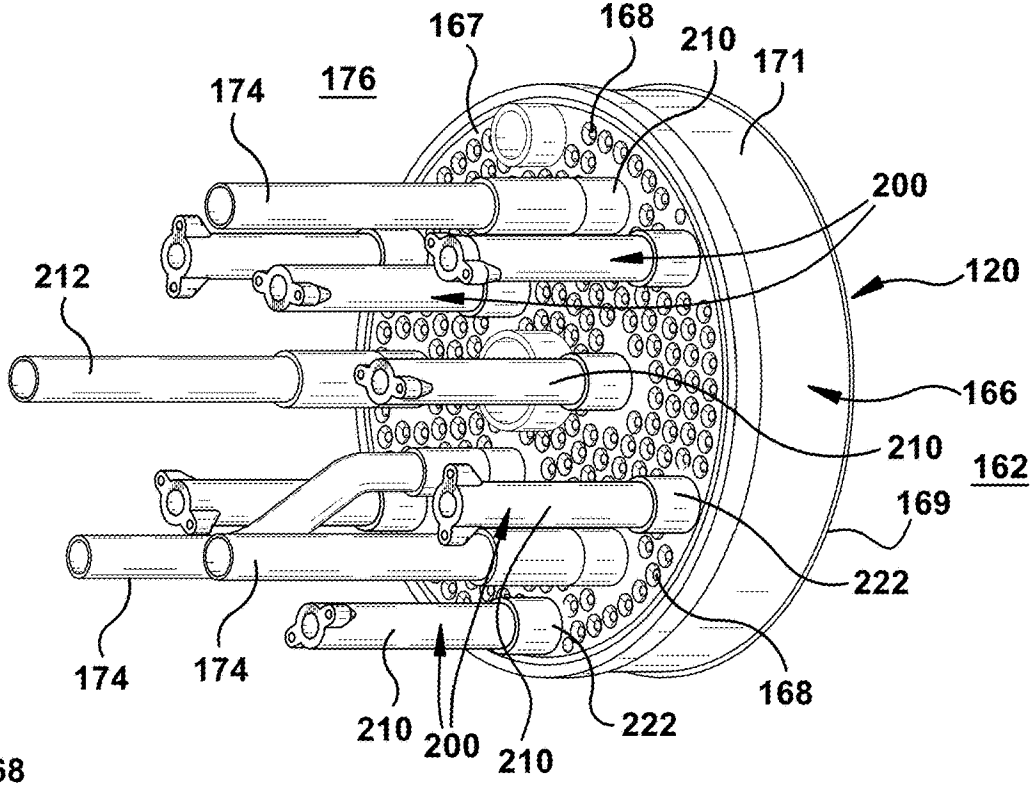
FIG. 3 shows a perspective view of a fuel nozzle assembly and a cap assembly thereof including a Helmholtz damper system, according to embodiments of the disclosure.
Figure 4:
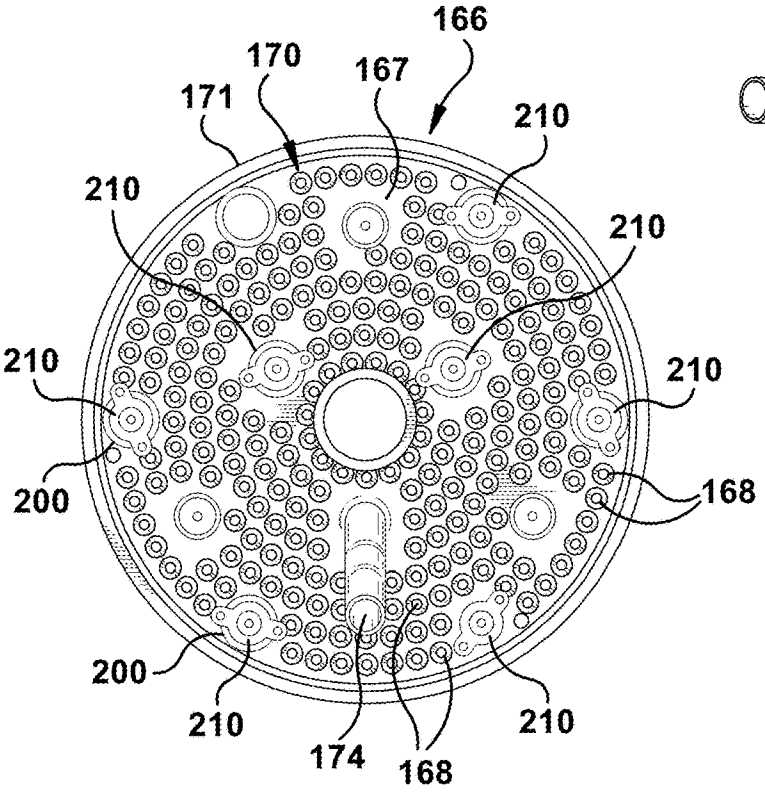
FIG. 4 shows a forward end view of a fuel nozzle assembly and a cap assembly including a Helmholtz damper system, according to embodiments of the disclosure.

FIG. 3 shows a perspective view and FIG. 4 shows a forward end view of cap assembly 166 (and fuel nozzle assembly 170) including a Helmholtz damper system 200 for combustor 100 of GT system 90, according to embodiments of the disclosure. FIGS. 3 and 4 also show one or more fluid conduits 174 for delivering one or more fuels 114A-C (FIG. 1) to fuel nozzle assembly 170. Helmholtz damper system 200 may include at least one damper element 210 in cap assembly 166 of combustor 100. As described herein, during operation, various operating parameters such as fuel temperature, fuel composition, ambient operating conditions, and/or operational load on GT system 90 may result in combustion dynamics or pressure pulses within combustor 100. The combustion dynamics may cause oscillation of various combustor 100 hardware components such as but not limited to liner(s) 160 and/or premixing tube(s) 168 of the fuel nozzles, which may result in undesirable wear of those components. Alternatively, or in addition, high frequencies of combustion dynamics may produce pressure pulses inside premixing tubes 168 and/or combustion chamber 162 that affect the stability of the combustion flame, reduce the design margins for flashback or flame holding, and/or increase undesirable emissions.

According to embodiments of the disclosure, damper element(s) 210 may be positioned amongst premixing tubes 168 in cap assembly 166 in any manner desired to address the combustor dynamics. As will be described, damper element(s) 210 are highly customizable to address, i.e., dampen, practically any range of combustion dynamic frequencies or any particular frequency of concern. In this regard, the different damper elements 210 used may be identical but, alternatively, may be configured differently to address different frequencies. FIGS. 3 and 4 show seven damper elements 210; however, any number may be used within a given Helmholtz damper system 200 depending on any of the previously described combustor dynamics to be addressed.

As understood in the art, a Helmholtz damper, also known as a Helmholtz resonator, includes an enclosed volume of air fluidly communicating with an outside environment through one or more small openings. The mostly enclosed air resonates at a single frequency that depends on, for example, the damping volume of the container and the geometry of the opening(s). In contrast, a quarter wave damper or resonator includes a container, tube or pipe open at one end and closed at the other end, where the length of the container, tube or pipe corresponds to one-quarter of the wavelength of the frequency of interest. In certain circumstances, the volume of air within the walls and rigid end can resonate to dampen vibrations.

FIGS. 5-9 show cross-sectional views of a damper element 210 according to various embodiments of the disclosure. Each damper element 210 includes a resonator tube 220 (hereafter "tube 220") configured to be positioned in a hollow mount 222 in cap assembly 166 of combustor 100. As shown in FIGS. 3 and 4, cap assembly 166 includes plurality of premixing tubes 168 (only one shown in FIGS. 5-7 for clarity) positioned adjacent hollow mount(s) 222 of damper element(s) 210. Cap assembly 166 includes, for example, a forward plate 167, an aft plate 169 (not shown in FIGS. 3-4, see FIG. 2) and an outer sleeve 171 extending between forward plate 167 and aft plate 169. As shown in FIGS. 5-9, each hollow mount 222 has a mount aft end 224 in fluid communication with combustion chamber 162 of combustor 100 and a mount forward end 226 opposing mount aft end 224. Mount forward end 226 is on an upstream side of cap assembly 166 and is disposed in air plenum 176 of head end portion 158 (FIG. 2). While hollow mount 222 is shown extending from cap assembly 166, i.e., at forward plate 167 thereof, into air plenum 176, this is not necessary in all cases.

Figure 6:
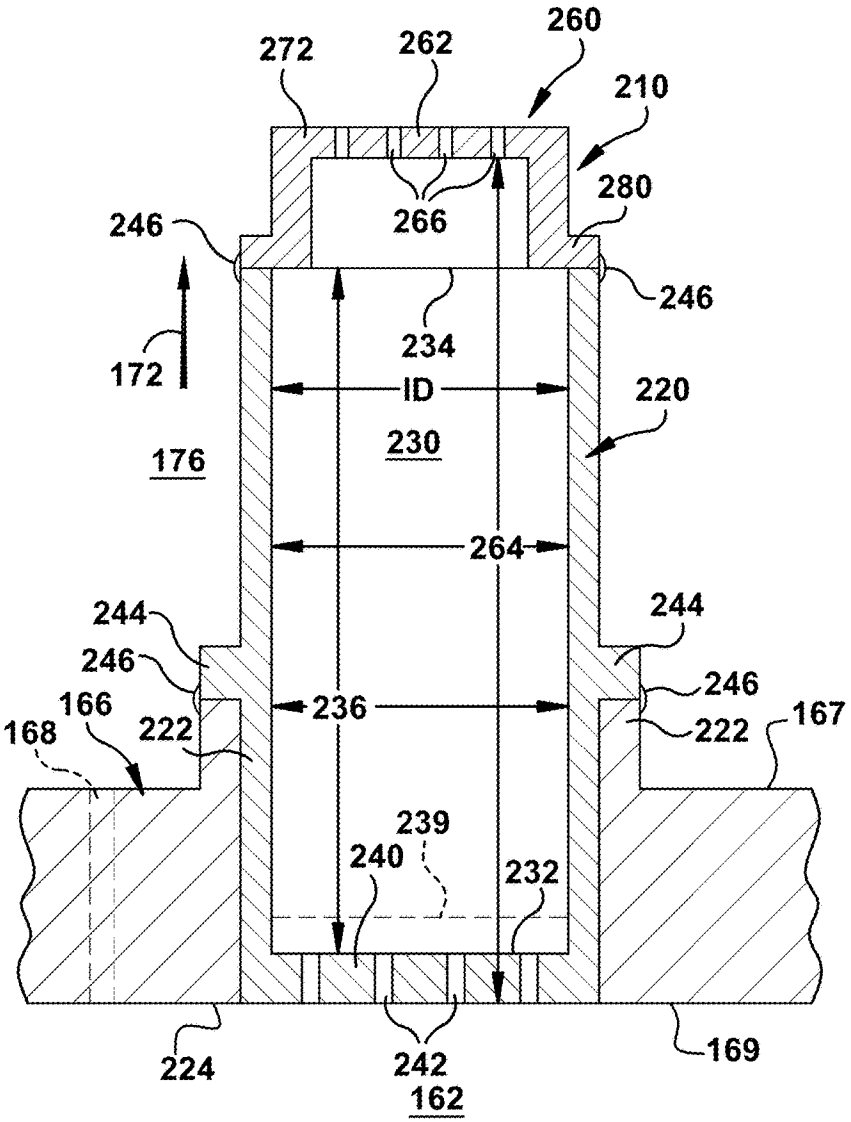
FIG. 6 shows a cross-sectional view of a damper element of a Helmholtz damper system, according to other embodiments of the disclosure.
Figure 5:
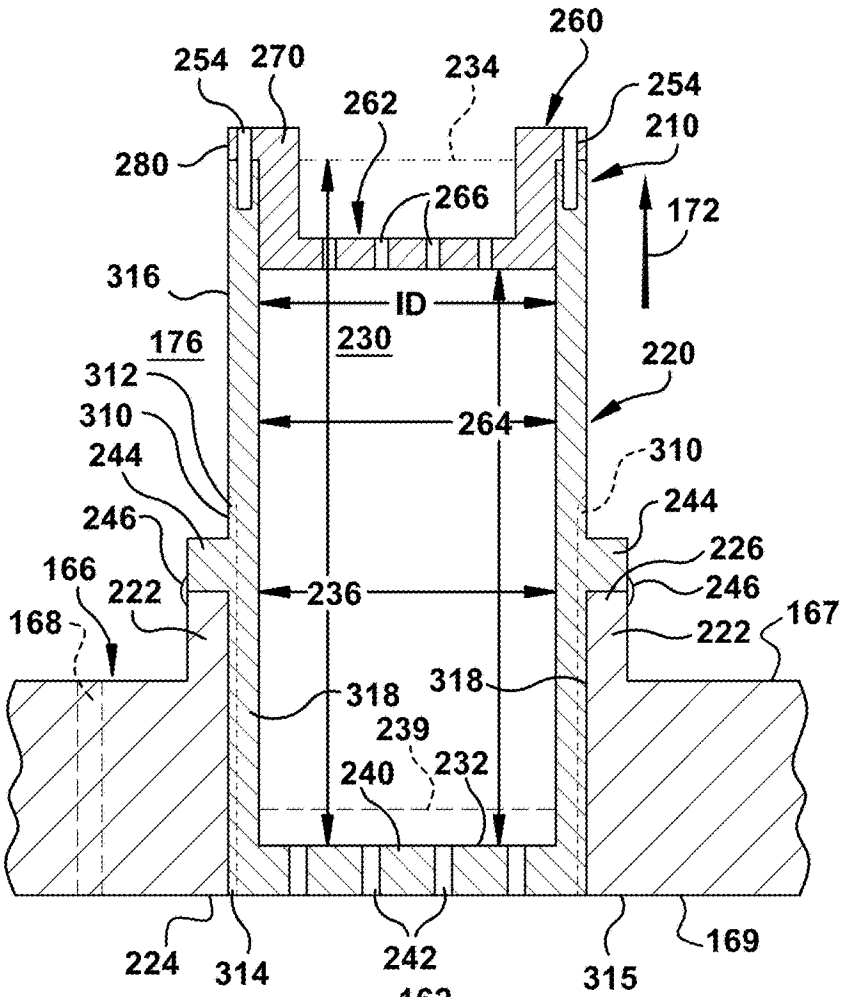
FIG. 5 shows a cross-sectional view of a damper element of a Helmholtz damper system, according to embodiments of the disclosure.

Tube 220 has a hollow body 230 having an aft end 232 and a forward end 234 opposite aft end 232. Tube 220 also has a volume 236 between aft end 232 and forward end 234. The extent of volume 236 is indicated with double-ended arrows. In certain embodiments, as shown in FIGS. 5 and 6, aft end 232 has a first perforated member 240 in fluid communication with combustion chamber 162. First perforated member 240 may include any plate-like structure that allows air flow therethrough in a restrained manner as dictated by a plurality of openings 242 therethrough. Openings 242 may have any desired number and/or cross-sectional size to provide the desired Helmholtz resonance. First perforated member 240 may also have any thickness to obtain the desired damping frequency.

Tube 220 may have any volume 236 desired to address a certain vibration frequency or frequency range. As shown by arrows, volume 236 is defined by an inner diameter (ID) of tube 220 and a length (L) of tube 220 between aft end 232 and forward end 234 thereof. Volume 236 for a particular damper element 210 may be selected to dampen a particular frequency or, more likely, a range of frequencies. In this regard, each damper element 210 may also have a tube 220 having a different length and/or inner diameter to create a different volume 236 compared to other damper elements 210 within a given Helmholtz damper system 200 (FIGS. 2-4). Tube 220 may have a circular inner and/or outer cross-section, but this is not necessary in all cases. However, tube 220 has an outer diameter and/or shape configured to fit within an inner diameter and/or shape of hollow mount 222 in a manner to prevent fluid flow therebetween, e.g., air from air plenum 176 or combustion gases 122 (FIG. 1) from combustion chamber 162.

Where desired, a damping weight 239 (dashed box) may also be positioned in aft end 232 of tube 220 to further adjust a resonant frequency of damper element 210 and hence the frequency it can dampen in combustor 100. Damping weight 239 is optional. More than one damping weight 239 may be used. Damping weight(s) 239 may be provided with apertures (not shown) or spaces therebetween, which are aligned with openings 242 in first perforated member 240 to permit fluid flow therethrough into volume 236.

Tube 220 may be positioned and/or secured to hollow mount 222 in a variety of ways. In terms of securing, tube 220 may be removably fastened to hollow mount 222 with at least one of a threaded fastener, a threaded joint, a weld, a twist-lock, and/or a pinned connection. In certain embodiments, tube 220 may include an external positioning member 244 between aft end 232 and forward end 234 thereof. External positioning member 244 may interact with mount forward end 226 of hollow mount 222 to position tube 220 relative to hollow mount 222, e.g., with aft end 232 of tube flush with mount aft end 224 of hollow mount 222 (and cap assembly 166). External positioning member 244 is shown as an external flange, but it can take any form capable of positioning tube 220 relative to hollow mount 222 as they telescopically move relative to one another.

Figure 7:
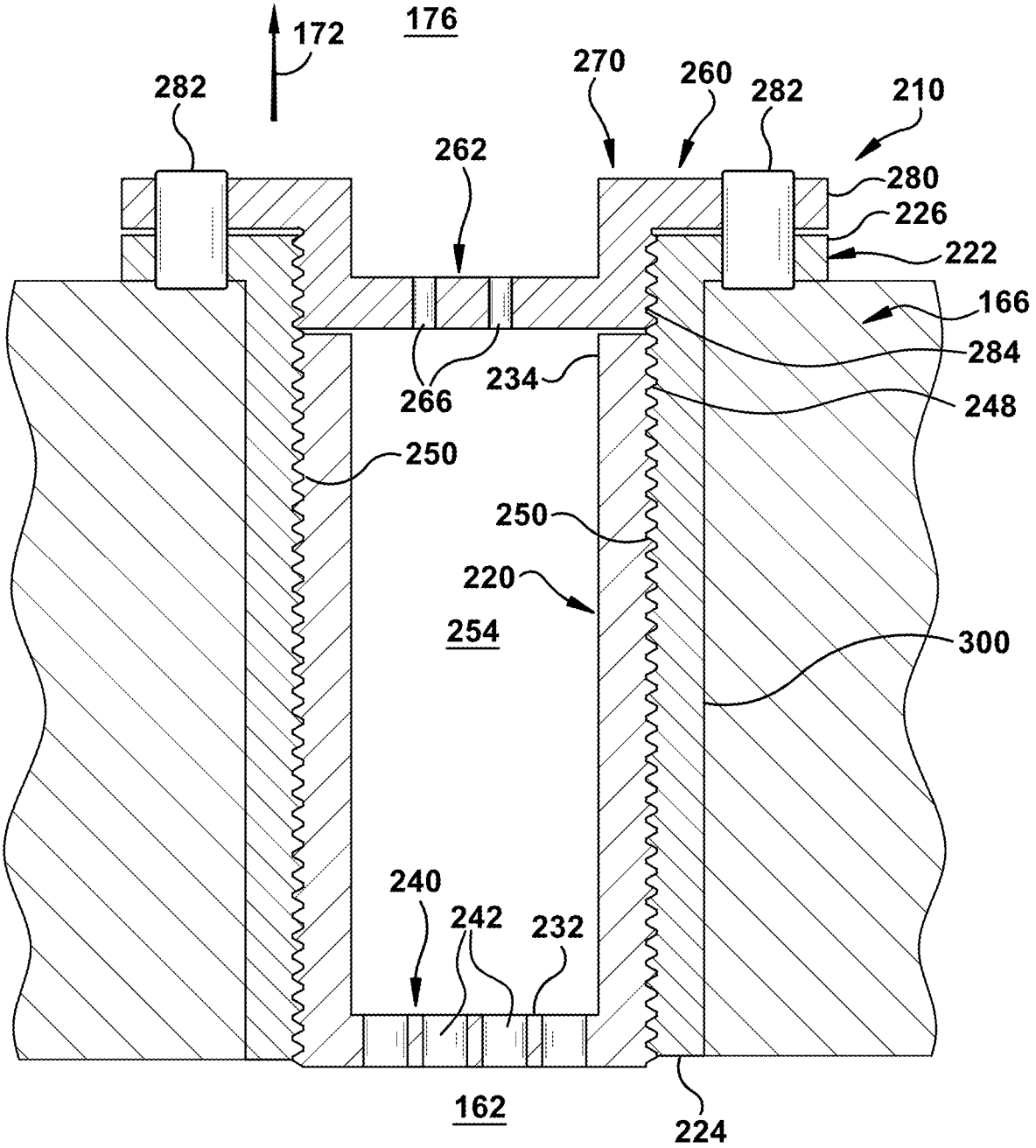
FIG. 7 shows a cross-sectional view of a damper element of a Helmholtz damper system, according to additional embodiments of the disclosure.

In terms of securing tube 220 with hollow mount 222, as shown in FIGS. 5 and 6, tube 220 may include a weld 246 to couple tube 220 to hollow mount 222, e.g., a (possibly breakable) weld coupling an exterior surface of tube 220 to mount forward end 226 of hollow mount 222 or a (possibly breakable) weld or fastener coupling external positioning member 244 to mount forward end 226 of hollow mount 222. In other embodiments, as shown in FIG. 7, tube 220 may include an externally threaded surface 248 configured to threadedly connect in an internally threaded surface 250 in hollow mount 222. In this case, forward end 234 of tube 220 may be aft of mount forward end 226 of hollow mount 222, i.e., tube 220 is entirely within a longitudinal extent of hollow mount 222. Tube 220 may be configured to receive a tool (not shown) for rotating it relative to hollow mount 222, such as but not limited to: a polygonal external surface at or near forward end 234 thereof for engagement by, for example, a wrench, or a polygonal internal surface within forward end 234 for engagement by a hex key (Allen key or wrench). Other mechanisms for rotating tube 220 relative to hollow mount 222 may also be possible.

In FIG. 7, a damping volume control member 260 (hereafter "control member 260" for brevity) is shown coupled to tube 220 by threaded fasteners 282. Specifically, as will be described further herein, control member 260, e.g., as a tubular insert 270, may have an external threaded surface 284 configured to threadedly connect with internal threaded surface 250 of hollow mount 222. In this latter case, as will be described herein relative to FIG. 11, positioning member 280 and threaded fasteners 282 could be omitted and tubular insert 270 could be threadedly connected within hollow mount 222.

In other embodiments, as shown in FIG. 8, tube 220 is removably fastened to hollow mount 222 with a twist-lock 252. Any variety of twist-lock 252 may be used. In other embodiments, as shown in FIG. 9, tube 220 is removably fastened to hollow mount 222 with a pinned-connection 254, e.g., through external positioning member 244 of tube 220 into mount forward end 226 of hollow mount 222. Other mechanisms for positioning and/or securing tube 220 with hollow mount 222 may also be possible and are considered within the scope of the disclosure.

With continuing reference to FIGS. 5-9, damper element(s) 210 also include a damping volume control member 260 (hereafter "control member 260" for brevity) coupled to tube 220 and having a second perforated member 262 positioned to selectively define a damping volume 264 from volume 236 of tube 220. The extent of damping volume 264 is indicated with double-ended arrows. The "damping volume" 264 is so referenced because it is the volume of damper element(s) 210 that will control a resonant frequency dampened by the element, i.e., it is the operative resonant volume of each damping element 210. Damping volume 264, in contrast to volume 236 of tube 220, is defined between second perforated member 262 of control member 260 and aft end 232 of hollow body 230 of tube 220. Second perforated member 262 may include any plate-like structure that allows air flow therethrough in a restrained manner as dictated by a plurality of openings 266 therethrough. Openings 266 may have any desired number and/or cross-sectional size to provide the desired Helmholtz resonance. Second perforated member 262 may also have any thickness to obtain the desired damping frequency. As illustrated, second perforated member 262 of control member 260 creates a forward extent of damping volume 264. More particularly, second perforated member 262 of control member 260 fluidly couples damping volume 264 and air plenum 176 defined forward (up on pages of FIGS. 5-9) of cap assembly 166, creating a Helmholtz resonator.

Control member 260 can take a variety of forms to customize damping volume 264 and, hence, the damping frequency of the respective damper element 210. More particularly, control member 260 can precisely control a frequency dampened by the respective damper element 210. Since control member 260 is removably fastened to tube 220, the arrangement allows for quick and easy customization of damping volume 264 and a resonant frequency of each damping element 210 in Helmholtz damping system 200 (FIG. 2).

As shown in FIGS. 5, 7 and 9, in certain embodiments, control member 260 includes a tubular insert 270 configured to be positioned in forward end 234 of tube 220 to define damping volume 264 by reducing volume 236 of tube 220. Tubular insert 270 can have at least a portion thereof having a cap-like or plug-like shape to mate within tube 220. This reduction of volume 236 to form a smaller damping volume 264 results in an increase in a damping frequency of the respective damper element 210. In one non-limiting example, the decrease of volume 236 of tube 220 may be in the range of 0.5-10%. In this case, second perforated member 262 of control member 260 is between forward and aft ends 232, 234, respectively, of tube 220. Tubular insert 270 may be sealed with tube 220 (or hollow mount 222 as in FIG. 11) in any now known or later developed manner such as tight diametrical tolerances, threaded connection, and/or any form of seal element (not shown) between control member 260 and forward end 234 of tube 220.

As shown in FIGS. 6 and 8, in other embodiments, control member 260 includes a volume enlarging member 272 configured to be positioned at forward end 234 of tube 220 to define damping volume 264 by increasing volume 236 of tube 220. This increase of volume 236 to create a larger damping volume 264 decreases the damping frequency of the respective damper element 210. In this case, second perforated member 262 of control member 260 is forward (up on page of FIGS. 6, 8) of forward end 234 of tube 220. Volume enlarging member 272 may have a top hat-like shape to increase volume 236 of tube 220. The extent of volume 236 increase can be user defined (based on the size of volume enlarging member 272) to achieve the precise damping volume desired. In one non-limiting example, the increase of volume 236 of tube 220 may be in the range of 0.5-10%. Volume enlarging member 272 may be sealed with tube 220 in any now known or later developed manner such as any form of seal element (not shown) between control member 260 and forward end 234 of tube 220.

FIGS. 10A-E show perspective views of damper elements 210 (apart from cap assembly 166) having different control members 260 thereon to provide different damping frequencies. FIG. 10A shows control member 260 in the form of tubular insert 270 having a size to decrease damping volume 264 and increase the damping frequency by, for example, 20 Hertz. FIG. 10B shows control member 260 in the form of tubular insert 270 having a size slightly larger than that in FIG. 10A to further decrease a size of damping volume 264 and increase the damping frequency by, for example, 40 Hertz. As will be recognized, sizing tubular inserts 270 to create a desired damping volume 264 allows customization of the damping frequency of a given damping element 210 without removing tube 220 or making other changes to cap assembly 166.

FIG. 10C shows control member 260 in the form of volume enlarging member 272 having a size to increase damping volume 264 and decrease the damping frequency by, for example, 20 Hertz. FIG. 10D shows control member 260 in the form of volume enlarging member 272 having a size slightly larger than that in FIG. 10C to further increase a size of damping volume 264 and decrease the damping frequency by, for example, 40 Hertz. The extent of volume 236 decrease can be user defined (based on the size of tubular insert 270) to achieve the precise damping volume desired. In one non-limiting example, the reduction of volume 236 of tube 220 may be in the range of 0.5-10%. As will be recognized, sizing volume enlarging member 272 to create a desired damping volume 264 allows customization of the damping frequency of a given damping element 210 without removing tube 220 or making other changes to cap assembly 166.

In some cases, volume 236 of tube 220 may provide the desired damping volume. In this case, as shown in FIG. 10E, control member 260 may include a flat plate 276 including second perforated member 262. Here, a size of damping volume 264 is identical to that of volume 236 of tube 220, retaining substantially the same damping frequency from that provided by tube 220.

Figure 12:
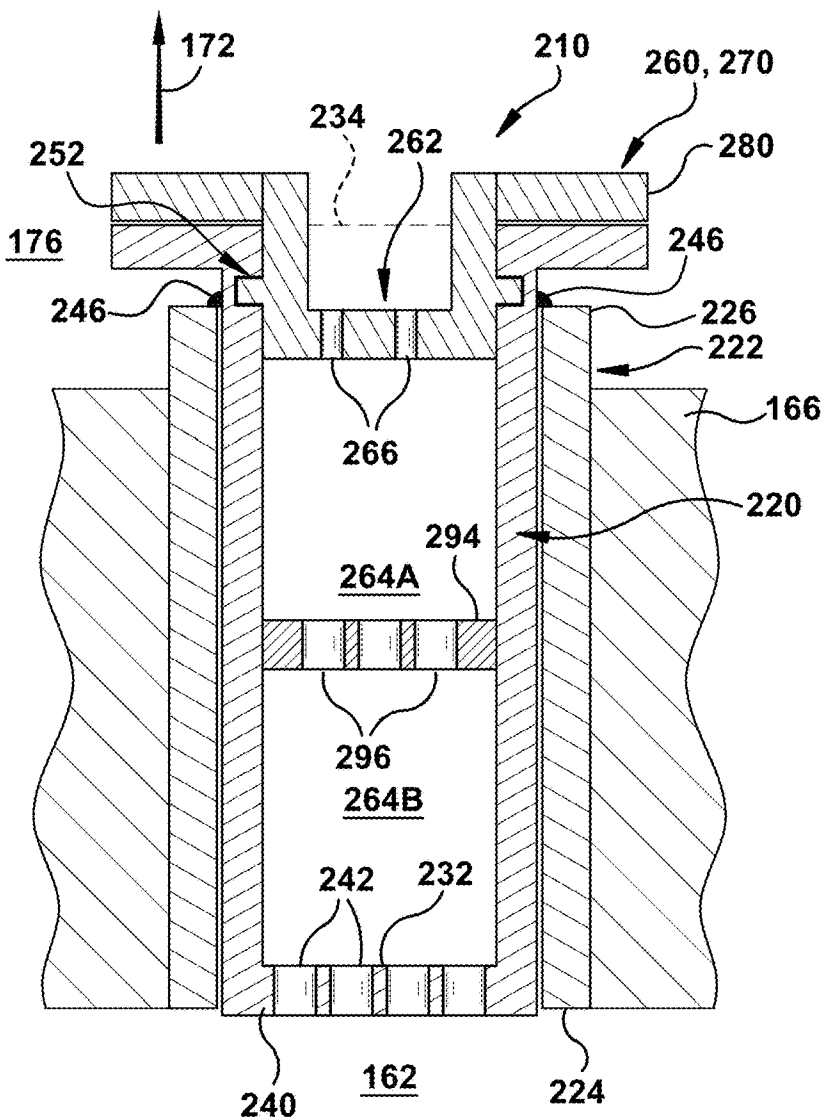
FIG. 12 shows a cross-sectional view of a damper element of a Helmholtz damper system, according to another alternative embodiment of the disclosure.
Figure 11:
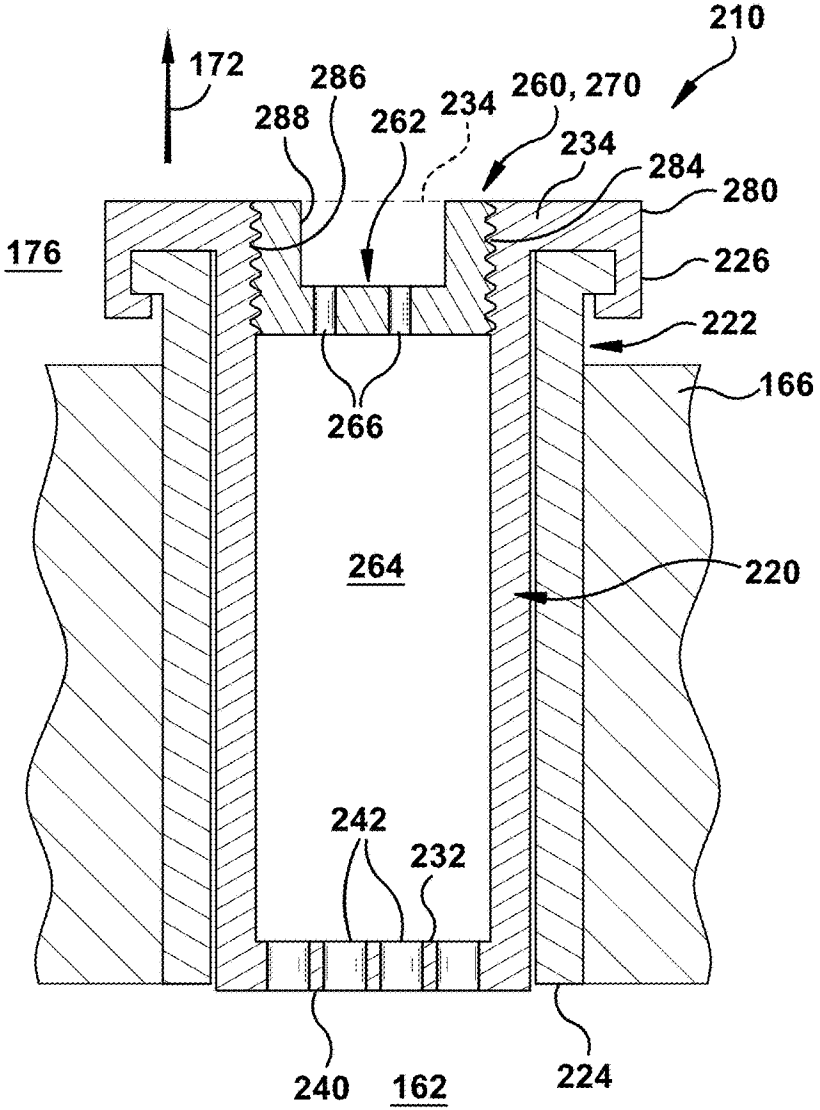
FIG. 11 shows a cross-sectional view of a damper element of a Helmholtz damper system, according to an alternative embodiment of the disclosure.

FIGS. 11 and 12 show cross-sectional views of damper elements 210 according to various alternative embodiments.

Control member 260 may be removably fastened to at least tube 220 in a number of ways. For example, control member 260 may be removably fastened to at least tube 220 with at least one of a threaded fastener, a threaded joint, a weld, a twist-lock, and a pinned-connection. In terms of positioning, in certain embodiments, as shown in FIGS. 5-10E, control member 260 may optionally include a positioning member 280 to position it relative to tube 220. Positioning member 280 may include any now known or later developed structure to align control member 260 with tube 220. In the example shown in, for example, FIG. 5, positioning member 280 includes a flange that aligns with tube 220, but other structures are also possible such as but not limited to aligned pins/openings and aligned external surfaces. In any event, positioning member 280 aligns control member 260 such that second perforated member 262 is operatively positioned relative to volume 236 of tube 220. It will be recognized that positioning member 280 may not be necessary in all cases. In terms of removable fastening of control member 260 to tube 220, as shown in the perspective view of FIGS. 10A-E, in certain embodiments, control member 260 may be removably fastened to at least tube 220 by threaded fastener(s) 282. As shown in FIG. 6, in other embodiments, control member 260 may be removably fastened to at least tube 220 by (possibly breakable) weld(s) 246. In other embodiments, as shown in the cross-sectional view of damper element 210 in FIG. 11, control member 260 may be removably fastened to at least tube 220 by a threaded connection. More particularly, control member 260 may include an externally threaded surface 284 configured to threadedly connect in an internally threaded surface 286 in tube 220. Control member 260 may be configured to receive a tool (not shown) for rotating it relative to tube 220, such as but not limited to: a polygonal external surface (not shown) of control member 260 for engagement by, for example, a wrench, or a polygonal internal surface 288 for engagement by a hex key (Allen key or wrench). In the example shown, at least a portion of tubular insert 270 and at least a portion of forward end 234 of tube 220 have mating threaded surfaces 284, 286, and tubular insert 270 is threadedly connected in at least forward end 234 of tube 220. However, as will be understood by those with skill in the art, depending on the extent of internally threaded surface 286 of tube 220, tubular insert 270 can be positioned at practically any location along tube 220 using a threaded connection. As shown in FIG. 11, in this latter case, tubular insert 270 may not include any positioning structure (e.g., 280 in FIG. 5) that would prevent its threading completely into tube 220.

Figure 13:
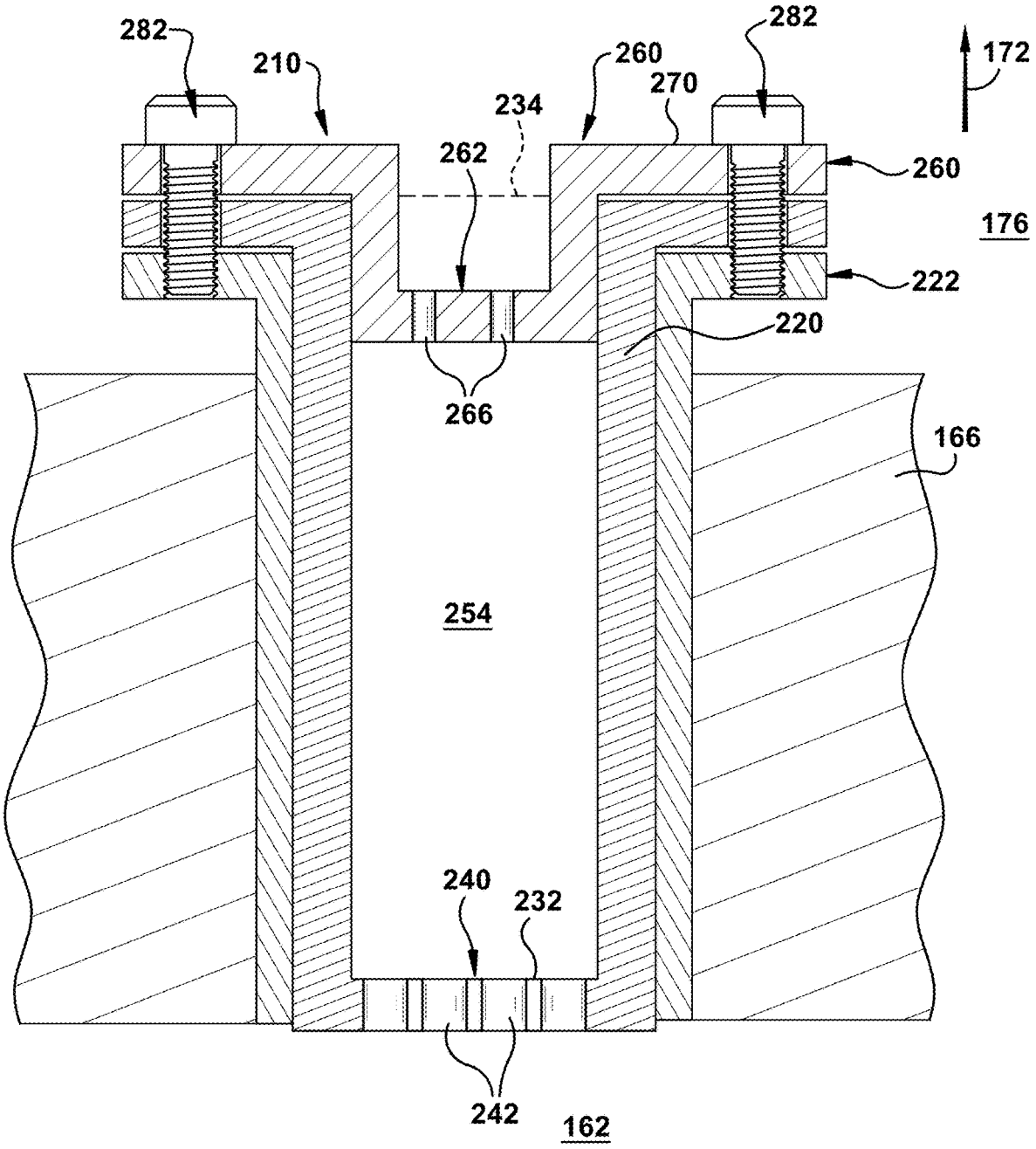
FIG. 13 shows a cross-sectional view of a damper element of a Helmholtz damper system in which a damping volume control member is coupled to a tube and a hollow mount, according to an alternative embodiment of the disclosure.

In other embodiments, as shown in the cross-sectional view of damper element 210 in FIG. 12, control member 260 is removably fastened to at least tube 220 with a twist-lock 290. Any variety of twist-lock(s) 290 may be used. In other embodiments, as shown in FIG. 5, control member 260 is removably fastened to at least tube 220 with a pinned-connection 290, e.g., through external positioning member 244 into at least tube 220. It will be recognized that any of the afore-described removable fastening mechanisms can be easily extended to also couple control member 260 to hollow mount 222, if desired, e.g., by lengthening the fastening structure to reach mount forward end 226 of hollow mount 222. FIG. 13 shows a cross-sectional view of one example in which control member 260 is coupled to tube 220 and also hollow mount 222, e.g., by threaded fasteners 282 that reach through part of tube 220 and into part of hollow mount 222. Other mechanisms for positioning and/or removably fastening control member 260 with at least tube 220 may also be possible and are considered within the scope of the disclosure.

With further reference to FIG. 12, in certain embodiments, tube 220 may also have a perforated divider member 294 between aft end 232 and forward end 234 thereof dividing the damping volume into a forward damping volume 264A between second perforated member 262 of control member 260 and perforated divider member 294 and an aft damping volume 264B between perforated divider member 294 and first perforated member 240 of tube 220. Perforated divider member 294 may include any plate-like structure that allows air flow therethrough in a restrained manner as dictated by a plurality of openings 296 therethrough. Openings 296 may have any desired number and/or cross-sectional shape or size to provide the desired Helmholtz resonance for each damping volume 264A, 264B. More particularly, openings 296 fluidly couple damping volumes 264A, 264B together, creating a forward Helmholtz resonator with control member 260 and an aft Helmholtz resonator with first perforated member 240 of tube 220. As illustrated, the location of perforated divider member 294 within tube 220 can be selected to size each of forward and aft damping volumes 264A, 264B (resonators) to dampen a desired frequency. While FIGS. 11 and 12 are illustrated with control member 260 in the form of tubular insert 270, it will be recognized that the teachings of FIGS. 11 and 12 can also be applied to control member 260 in the form of volume enlarging member 272.

Figure 14:
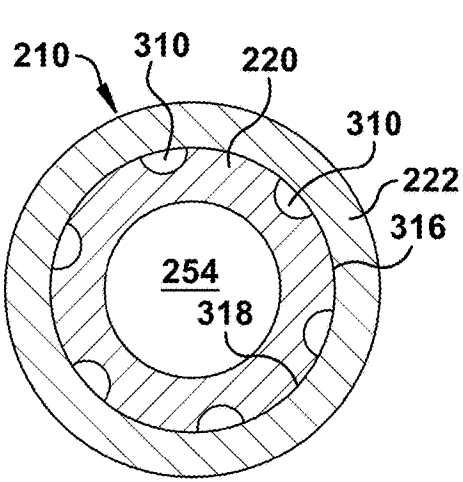
FIG. 14 shows a cross-sectional view along view line 14-14 in FIG. 10A.

With further reference to FIGS. 5 and 10A, in certain embodiments, damper element(s) 210 may also include a plurality of cooling passages 310 defined at least partially longitudinally in tube 220. Each cooling passage 310 has an inlet 312 in fluid communication with air plenum 176 defined forward of cap assembly 166 (see FIG. 2) and an outlet 314. Air 112 (FIG. 2) from air plenum 176 travels through cooling passages 310 to cool tube 220 and/or hollow mount 222. Outlet 314 may be in direct fluid communication with combustion chamber 162 so the air can be used to supplement the combustion reaction on combustion chamber 162. Alternatively, outlet 314 may be directed radially outward from center of damper element 210 toward hollow mount 222 to further cool hollow mount 222 or an aft facing surface 315 (FIG. 5) of cap assembly 166. FIG. 14 shows a cross-sectional view along view line 14-14 in FIG. 10A. In FIGS. 5, 10A and 14, cooling passages 310 are formed as channels in an external surface 316 of tube 220. As shown in FIGS. 5 and 14, the channels are closed off over most of their lengths by the interaction of external surface 316 of tube 220 with an internal surface 318 of hollow mount 222, creating cooling passages 310.

Figure 16:
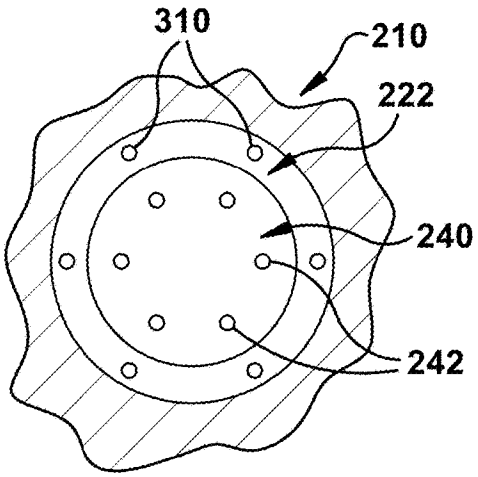
FIG. 16 shows a cross-sectional view along view line 16-16 in FIG. 15.
Figure 15:
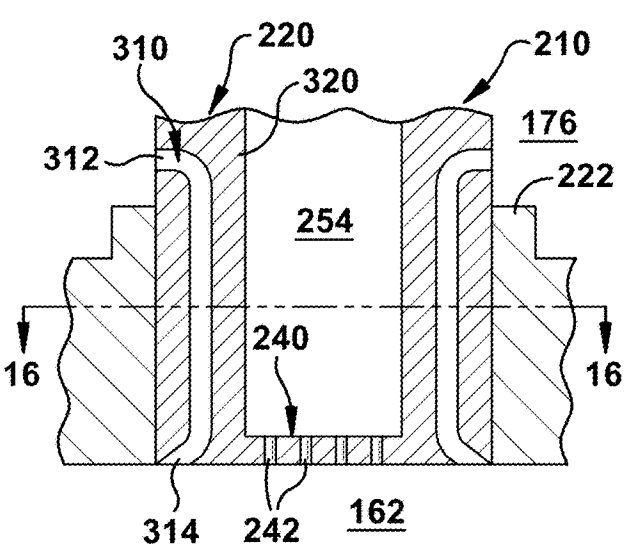
FIG. 15 shows an enlarged cross-sectional view of part of a damper element of a Helmholtz damper system, according to other embodiments of the disclosure.

FIG. 15 shows an enlarged cross-sectional view of part of damper element 210, and FIG. 16 shows a cross-sectional view along view line 16-16 in FIG. 15, according to other embodiments of the disclosure. In certain embodiments, shown in FIGS. 15-16, tube 220 includes plurality of cooling passages 310 that are fully defined at least partially longitudinally in tube 220, e.g., as microchannels within a wall 320 of hollow body 230 of tube 220. Otherwise, cooling passages 310 are as described previously relative to FIGS. 5, 10A and 14. Where cooling passages 310 are provided, regardless of their form, any number can be used and they may be circumferentially spaced in any desired manner, e.g., uniformly around tube 220.

Figure 17:
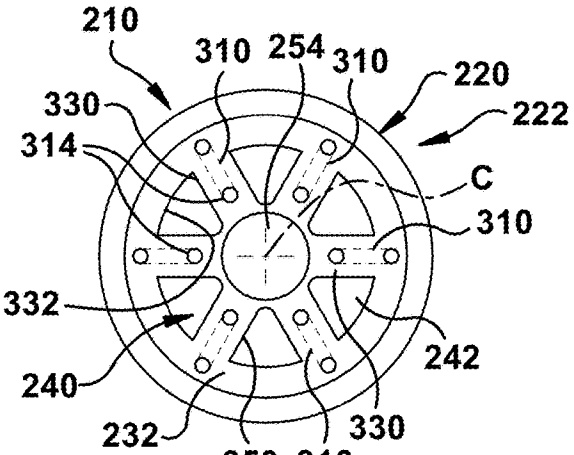
FIG. 17 shows an end view of a damper element of a Helmholtz damper system, according to other embodiments of the disclosure.

FIG. 17 shows an end view of a damper element 210 according to other embodiments. In FIG. 17, first perforated member 240 of tube 220 is reconfigured compared to previously described embodiments. As shown in FIG. 17, in certain embodiments, first perforated member 240 may include a plurality of cooling members 330 extending from an inner surface 332 of tube 220 toward a center C of tube 220 at aft end 232 thereof. In the illustrated embodiment, each cooling member 330 extends radially inward (e.g., as a spoke) toward center C, although other angular orientations are possible. Each cooling member 330 includes a portion of a respective cooling passage 310 defined therein and a respective outlet 314 of the respective cooling passage 310. Outlets 314 are directed into combustion chamber 162 (out of page in FIG. 17). Hence, cooling members 330 redirect air coolant radially inward in tube 220, and direct the air coolant into combustion chamber 162 in a more central location of damper element 210.

Cooling members 330 may also define openings 242 of first perforated member 240 as pie-shaped openings, rather than distinct circular or oblong openings as in other embodiments disclosed herein. While six cooling members 330 are shown in FIG. 17, any number of cooling members 330 can be used. Cooling members 330 can also have different longitudinal shapes to allow different shaped and/or sized openings 242. In any regard, cooling member 330 can be arranged to create any desired damping frequency with other features of damping element(s) 210, as described herein.

Figure 18:
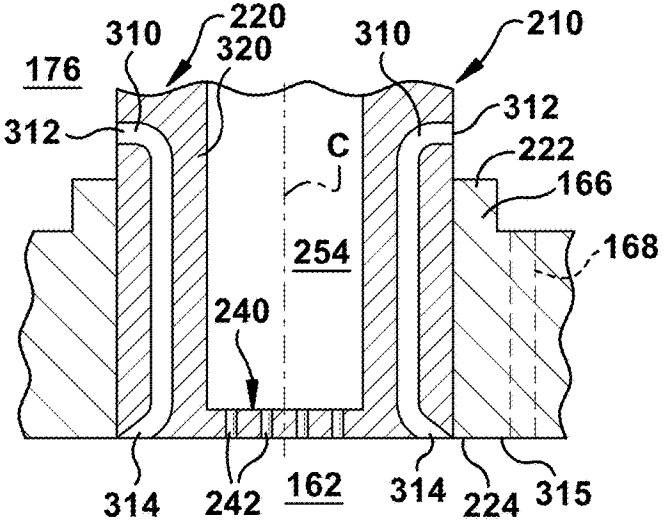
FIG. 18 shows an enlarged cross-sectional view of part of a damper element of a Helmholtz damper system, according to additional embodiments of the disclosure.

FIG. 18 shows an enlarged cross-sectional view of part of damper element(s) 210, according to other embodiments of the disclosure. Here, damper element(s) 210 also include a plurality of cooling passages 310 defined at least partially longitudinally in tube 220, and each cooling passage 310 has inlet 312 in fluid communication with air plenum 176 defined forward of cap assembly 166 (see FIG. 2) and outlet 314. Air 112 (FIG. 2) travels through cooling passages 310 to cool tube 220 and/or hollow mount 222. In contrast to FIGS. 15 and 16, in FIG. 18, outlet 314 may be directed radially outward from center C of tube 220. More particularly, outlets 314 of cooling passages 310 may be directed radially outward from a center C of damper element(s) 210 toward hollow mount 222 to further cool hollow mount 222, premixing tubes 168, or an aft facing surface 315 of cap assembly 166, e.g., near mount aft end 224 of hollow mount 222 therein.

FIGS. 19-24 show damper element 210 according to various additional embodiments of the disclosure.

Figure 19:
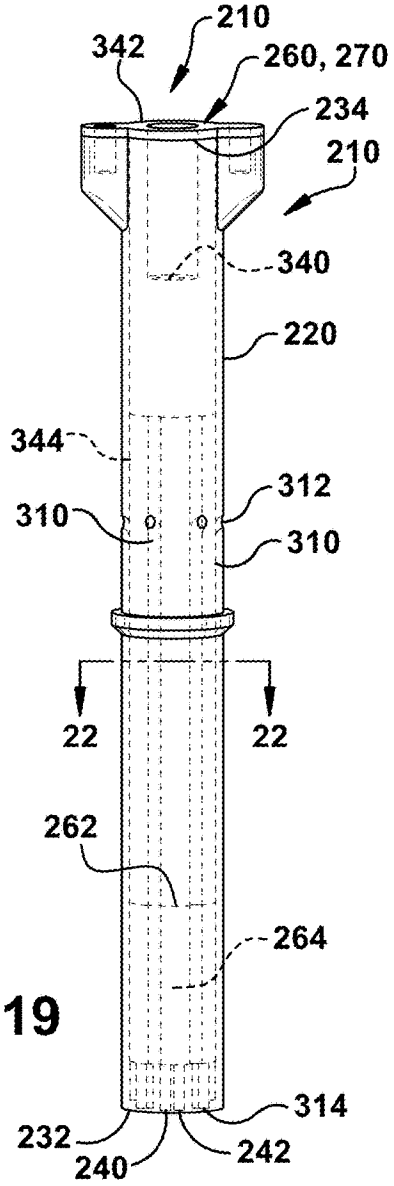
FIG. 19 shows a perspective view of a damper element of a Helmholtz damper system, according to various additional embodiments of the disclosure.
Figure 20:
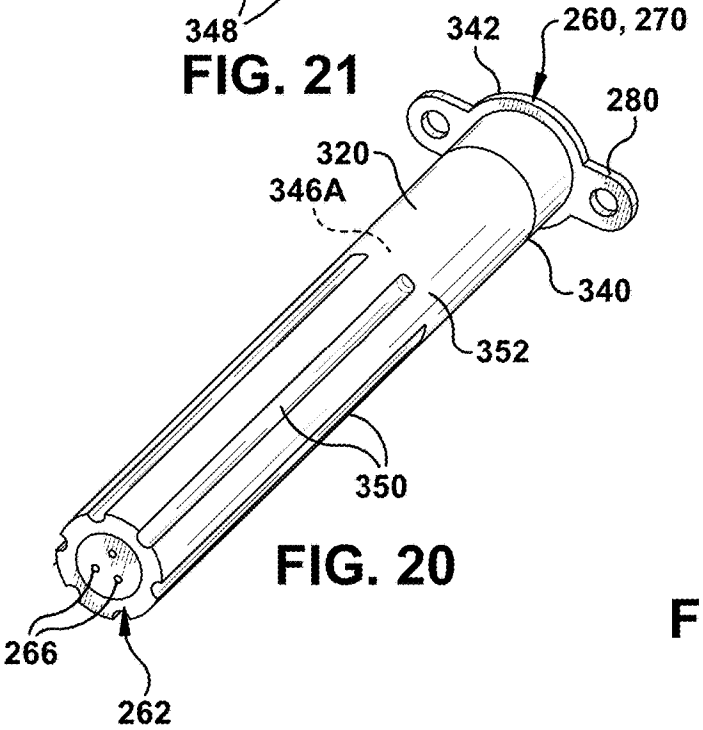
FIG. 20 shows a perspective view of a damping volume control member from the damper element in FIG. 19.

FIG. 19 shows a perspective view of damper element 210 according to additional embodiments of the disclosure; and FIG. 20 shows a perspective view of control member 260 from damper element 210 shown in FIG. 19. In certain embodiments, damper element 210 may include control member 260 in the form of tubular insert 270 that is elongated compared to other embodiments described herein. For example, rather than reducing volume 236 of tube 220 by a relatively small amount in the range of, for example, 0.5-10%, tubular insert 270 may reduce volume 236 by more than 10%. In other embodiments, tubular insert 270 may reduce volume 236 by 25%, 30%, 35%, 40%, 45%, 50% or more than 50%. Here, first perforated member 240 of tube 220 is in fluid communication with combustion chamber 162 and may include any plate-like structure that allows air flow therethrough in a restrained manner as dictated by plurality of openings 242 therethrough. However, second perforated member 262 is positioned closer to first perforated member 240 (compared to earlier described embodiments) to selectively define a smaller damping volume 264 from the volume of tube 220. Otherwise, second perforated member 262 is as described herein.

Figure 21:
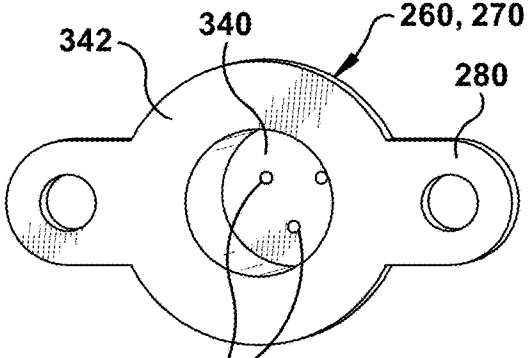
FIG. 21 shows a top-down view of a damping volume control member in the form of a tubular insert, according to an optional embodiment of the disclosure.

FIG. 21 shows a top-down view of control member 260 in the form of tubular insert 270 according to an optional embodiment. Although not necessary in all cases, tubular insert 270, as in FIGS. 19 and 20, may optionally include a supplemental perforated divider member 340 between a forward end 342 of tubular insert 270 and second perforated member 262 of tubular insert 270. Supplemental perforated divider member 340 and a supplemental damping volume 344 created thereby are shown in FIG. 19 in dashed lines. As shown in FIG. 19, where provided, supplemental perforated divider member 340 creates supplement damping volume 344 between it and second perforated member 262 of tubular insert 270. In this manner, damper element 210 may include damping volume 264 between second perforated member 262 of control member 260 (tubular insert 270) and first perforated member 240 of tube 220, and also may include supplemental damping volume 344 between second perforated member 262 and supplemental perforated divider member 340. Damping volume 264 is within tube 220, and supplemental damping volume 344 is within tubular insert 270.

Supplemental perforated divider member 340 may include any plate-like structure that allows air flow therethrough in a restrained manner as dictated by a plurality of openings 348 (FIG. 21) therethrough. Openings 348 may have any desired number and/or cross-sectional size or shape, and divider member 340 may have any desired thickness to provide the desired Helmholtz resonance for each damping volume 264, 344. As illustrated, the location of supplemental perforated divider member 340 within tubular insert 270 dictates a size of supplemental damping volume 344 and, hence, at least in part, the frequency dampened thereby.

Figure 22:
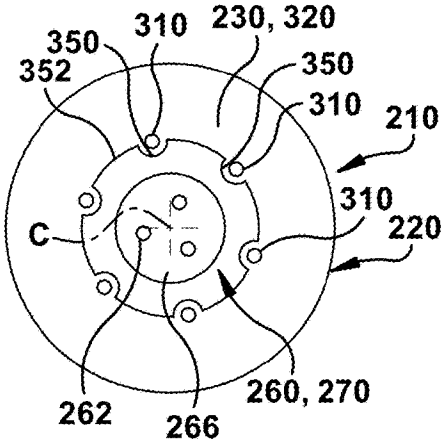
FIG. 22 shows a cross-sectional view along view line 22-22 in FIG. 19.

FIG. 22 shows a cross-sectional view along view line 22-22 in FIG. 19. As described herein, in certain embodiments, cooling passages 310 may be provided in hollow body 230 of tube 220. As shown in FIG. 22, in some embodiments, wall 320 of tube 220 in which cooling passage(s) 310 are located may include a length (into/out of page of FIG. 22) extending radially inward toward a center C of tube 220. This arrangement may be desired, for example, to allow for larger diameter cooling passages 310 in wall 320 of hollow body 230 of tube 220. To accommodate cooling passages 310 in this arrangement, and where control member 260 is in the form of tubular insert 270 configured to be positioned in forward end 234 of tube 220, tubular insert 270 may include a recess 350 in an exterior surface 352 thereof to receive the length of wall 320 including cooling passage(s) 310 therein. A recess 350 may be provided for each portion of wall 320 including cooling passage 310 that extends radially inward towards center C of tube 220. This arrangement may also assist in aligning tubular insert 270 in tube 220 and preventing rotation of tubular insert 270 relative to tube 220.

Figure 23:
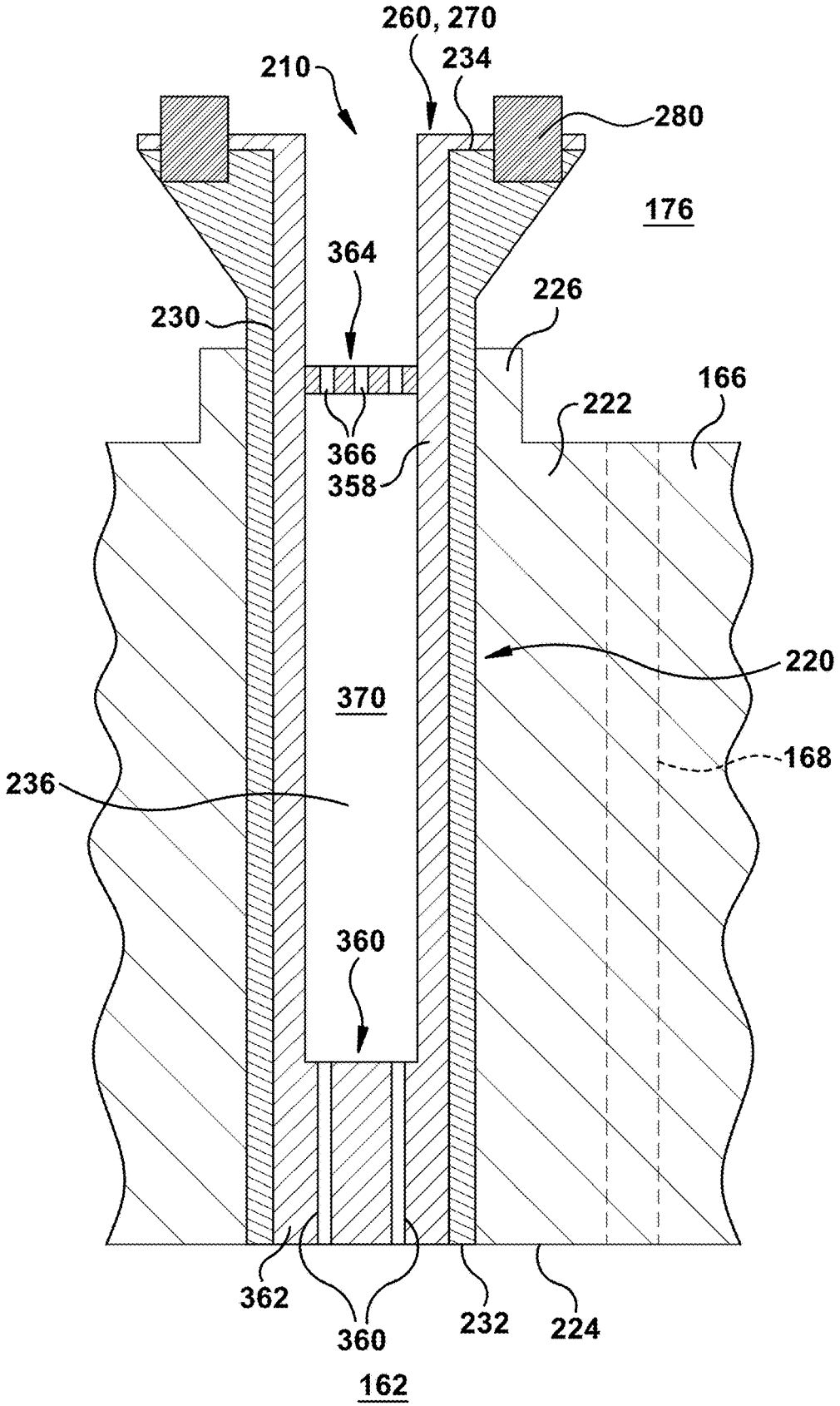
FIG. 23 shows a cross-sectional view of a damper element of a Helmholtz damper system, according to other embodiments of the disclosure.
Figure 24:
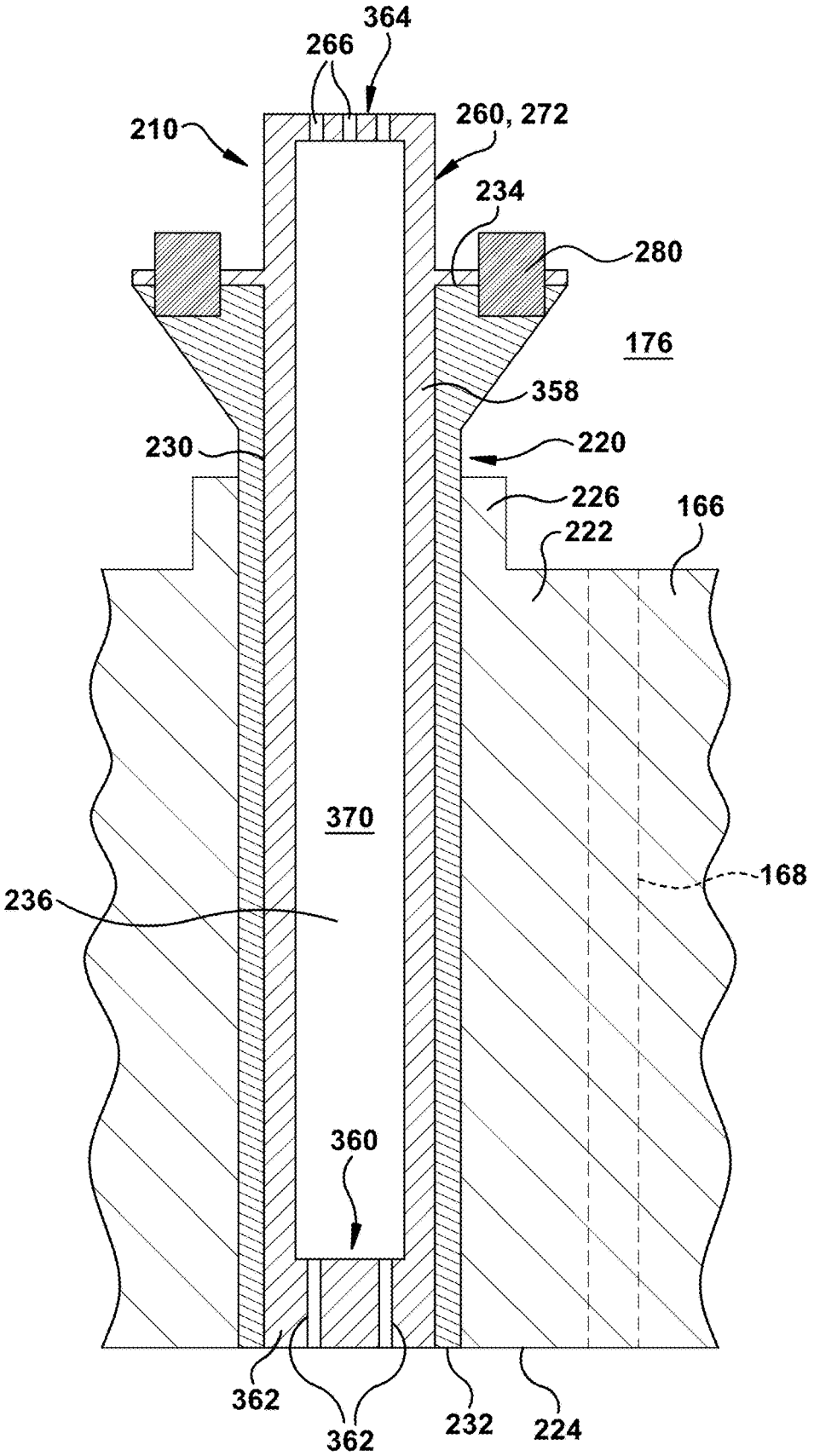
FIG. 24 shows a cross-sectional view of a damper element of a Helmholtz damper system, according to other embodiments of the disclosure.

FIGS. 23 and 24 show cross-sectional views of damper element 210 according to other embodiments. In the FIGS. 23 and 24 embodiments, control member 260 extends an entire length of tube 220, i.e., from forward end 234 to aft end 232 of tube 220. Here, tube 220 is configured to be positioned in hollow mount 222 in cap assembly 166 of combustor 100 (FIGS. 1-2), as described herein. Hollow mount 222 has mount aft end 224 in fluid communication with combustion chamber 162 of combustor 100 (FIGS. 1-2) and mount forward end 226 opposing mount aft end 224. Tube 220 has hollow body 230 having aft end 232 in fluid communication with combustion chamber 162, forward end 234 opposite aft end 232, and volume 236 between aft end 232 and forward end 234. However, tube 220 does not include any perforated member(s) as in other embodiments described herein. Damping volume control member 260 includes a tubular body 358 within an entire length of tube 220. Control member 260 has a first perforated member 360 for positioning at aft end 362 of tubular body 358 and within tube 220 (i.e., adjacent aft end 232 of tube 220).

Control member 260 also includes a second perforated member 364 positioned forward of first perforated member 360 to selectively define a damping volume 370 between first and second perforated members 360, 364. Damping volume 370 controls a frequency dampened by the respective damper element 210. In FIG. 23, second perforated member 364 is positioned aft of forward end 234 of tube 220, and damping volume 370 is between forward and aft ends 234, 232, respectively, of tube 220. Hence, second perforated member 360 defines damping volume 370 that is less than a volume 236 of tube 220, increasing a damping volume of damper element 210. In FIG. 24, second perforated member 364 is positioned forward of forward end 234 of tube 220, i.e., it extends forwardly into air plenum 176 and past tube 220. In this case, damping volume 370 is partially between forward and aft ends 234, 232, respectively, of tube 220 and partially forward of forward end 234 of tube 220. Perforated members 360, 364 can take any form and can be customized in any manner as previously described herein.

While adjustment of a damping frequency using changes of volume using control members 260 have been described herein, it is emphasized that various other structures of control member 260 may also be changed to adjust a damping frequency such as but not limited to: material and/or characteristics thereof (e.g., porosity, rigidity, etc.), a thickness of second perforated member 262, an internal shape of control member 260, and/or the cross-sectional area and/or shape of openings 266 therein. In addition, structures of tube 220 may also be changed to adjust a damping frequency such as but not limited to: material and/or physical characteristics thereof (e.g., porosity, rigidity, etc.) and/or the cross-sectional area and/or shape thereof.

Embodiments of the disclosure also include fuel nozzle assembly 170 (FIGS. 2-4) including Helmholtz damper system 200 as described herein. As described herein, cap assembly 166 includes fuel nozzles containing premixing tubes 168, which are positioned adjacent hollow mount 222 of at least one damper element 210 of system 200.

Embodiments of the disclosure also include combustor 100 (FIGS. 1-2) including fuel nozzle assembly 170 as described herein. As noted, combustion chamber 162 is downstream of fuel nozzle assembly 170.

Figures 25, 26:
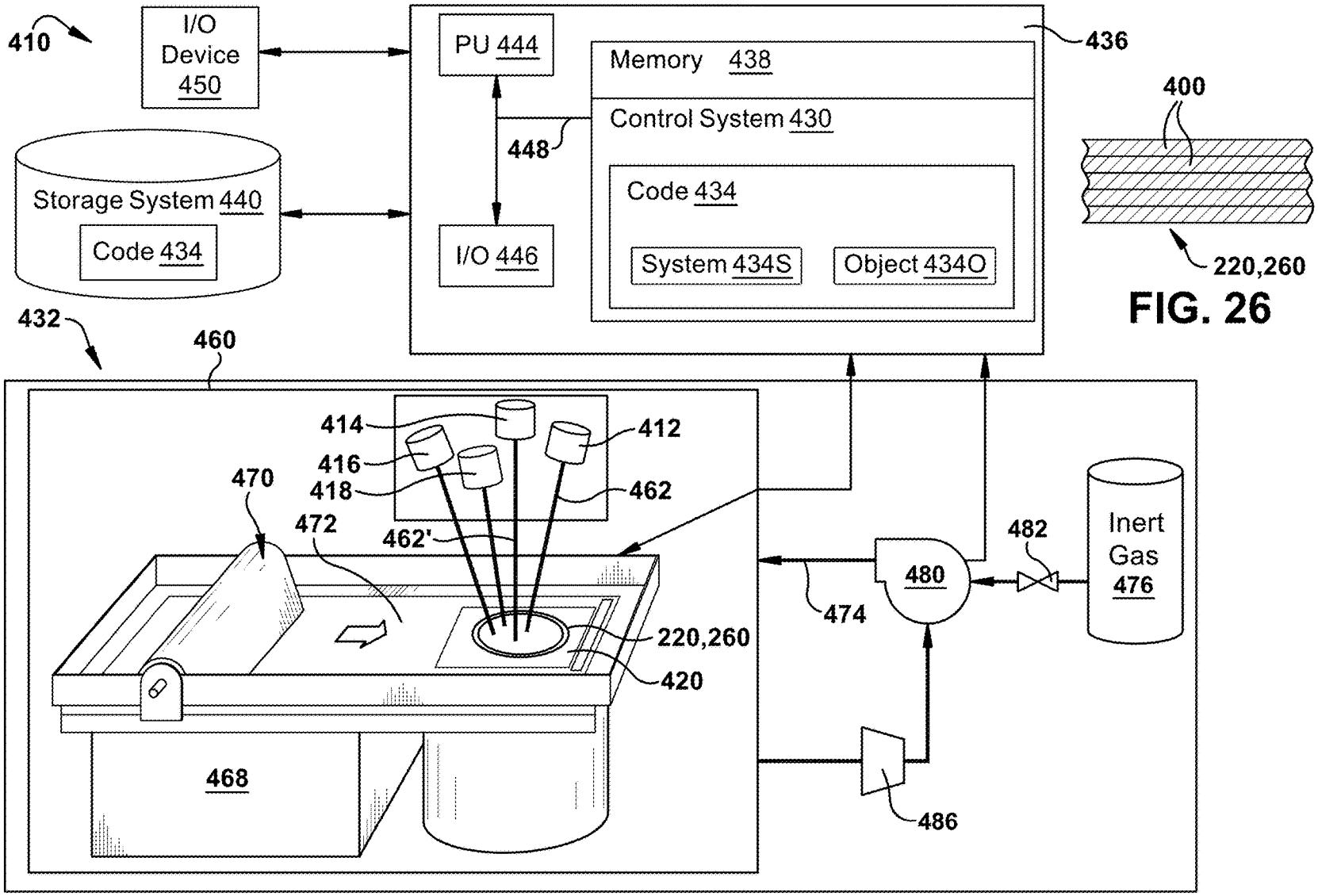
FIG. 25 shows a schematic block diagram of an illustrative additive manufacturing system for additively manufacturing one or more parts of a damper element of a Helmholtz damper system, according to embodiments of the disclosure.
FIG. 26 shows a cross-sectional view of a plurality of parallel, metallurgically bonded metal layers of a part of a damper element of a Helmholtz damper system, according to embodiments of the disclosure.

One or more parts of damper element(s) 210 described herein may be additively manufactured. For example, tube 220 and/or damping volume control member 260 may be additively manufactured. FIG. 25 shows a schematic/block view of an illustrative computerized metal powder additive manufacturing system 410 (hereinafter 'AM system 410') for generating part(s) of damper element 210, of which only a single layer is shown. The teachings of the disclosures will be described relative to building part(s) of damper element 210 using multiple melting beam sources 412, 414, 416, 418, but it is emphasized and will be readily recognized that the teachings of the disclosure are equally applicable to build part(s) of damper element 210 using any number of melting beam sources. In this example, AM system 410 is arranged for direct metal laser melting (DMLM). It is understood that the general teachings of the disclosure are equally applicable to other forms of metal powder additive manufacturing such as but not limited to selective laser melting (SLM) or direct metal laser sintering (DMLS), and perhaps other forms of additive manufacturing (i.e., other than metal powder applications). The layer of part(s) of damper element 210 in build platform 420 is illustrated as a circular element in FIG. 25; however, it is understood that the additive manufacturing process can be readily adapted to manufacture any shape on build platform 420, e.g., that of any part of damper element 210.

AM system 410 generally includes an additive manufacturing control system 430 ("control system") and an AM printer 432. As will be described, control system 430 executes set of computer-executable instructions or code 434 to generate part(s) of damper element 210 using multiple melting beam sources 412, 414, 416, 418. In the example shown, four melting beam sources may include four lasers. However, the teachings of the disclosures are applicable to any melting beam source, e.g., an electron beam, laser, etc. Control system 430 is shown implemented on computer 436 as computer program code. To this extent, computer 436 is shown including a memory 438 and/or storage system 440, a processor unit (PU) 444, an input/output (I/O) interface 446, and a bus 448. Further, computer 436 is shown in communication with an external I/O device/resource 450. In general, processor unit (PU) 444 executes computer program code 434 that is stored in memory 438 and/or storage system 440. While executing computer program code 434, processor unit (PU) 444 can read and/or write data to/from memory 438, storage system 440, I/O device 450 and/or AM printer 432. Bus 448 provides a communication link between each of the components in computer 436, and I/O device 450 can comprise any device that enables a user to interact with computer 436 (e.g., keyboard, pointing device, display, etc.).

Computer 436 is only representative of various possible combinations of hardware and software. For example, processor unit (PU) 444 may comprise a single processing unit or be distributed across one or more processing units in one or more locations, e.g., on a client and server. Similarly, memory 438 and/or storage system 440 may reside at one or more physical locations. Memory 438 and/or storage system 440 can comprise any combination of various types of non-transitory computer readable storage medium including magnetic media, optical media, random access memory (RAM), read only memory (ROM), etc. Computer 436 can comprise any type of computing device such as an industrial controller, a network server, a desktop computer, a laptop, a handheld device, etc.

As noted, AM system 410 and, in particular control system 430, executes code 434 to generate part(s) of damper element 210. Code 434 can include, among other things, a set of computer-executable instructions 434S (herein also referred to as 'code 434S') for operating a system (i.e., AM printer 432) and a set of computer-executable instructions 434O (herein also referred to as 'code 434O') for defining an object (i.e., part(s) of damper element 210) to be physically generated by AM printer 432. As described herein, additive manufacturing processes begin with a non-transitory computer readable storage medium (e.g., memory 438, storage system 440, etc.) storing code 434. Set of computer-executable instructions 434S for operating AM printer 432 may include any now known or later developed software code capable of operating AM printer 432.

The set of computer-executable instructions 434O defining part(s) of damper element 210 may include a precisely defined 3D model of part(s) of damper element 210 and can be generated from any of a large variety of well-known computer aided design (CAD) software systems such as AutoCAD®, TurboCAD®, DesignCAD 3D Max, etc. In this regard, code 434O can include any now known or later developed file format. Furthermore, code 434O representative of the part to be built, e.g., part(s) of damper element 210, may be translated between different formats. For example, code 434O may include files in Standard Tessellation Language (STL), which was created for stereolithography CAD programs of 3D Systems, or an additive manufacturing file (AMF), which is an American Society of Mechanical Engineers (ASME) standard that is an extensible markup-language (XML) based format designed to allow any CAD software to describe the shape and composition of any three-dimensional object to be fabricated on any AM printer.

Code 434O representative of part(s) of damper element 210 may also be converted into a set of data signals and transmitted, received as a set of data signals and converted to code, stored, etc., as necessary. Code 434O may be configured according to embodiments of the disclosure to allow for formation of border and internal sections in overlapping field regions, as will be described. In any event, code 434O may be an input to AM system 410 and may come from a part designer, an intellectual property (IP) provider, a design company, the operator or owner of AM system 410, or from other sources. In any event, control system 430 executes code 434S and 434O, dividing part(s) of damper element 210 into a series of thin slices that assembles using AM printer 432 in successive layers of material.

AM printer 432 may include a processing chamber 460 that is sealed to provide a controlled atmosphere for part(s) of damper element 210 printing. A build platform 420, upon which part(s) of damper element 210 is/are built, is positioned within processing chamber 460. A number of melting beam sources 412, 414, 416, 418 are configured to melt layers of metal powder on build platform 420 to generate part(s) of damper element 210. While four melting beam sources 412, 414, 416, 418 are illustrated, it is emphasized that the teachings of the disclosure are applicable to a system employing any number of sources, e.g., 1, 2, 3, or 5 or more. As understood in the field, each melting beam source 412, 414, 416, 418 may have a field including a non-overlapping field region, respectively, in which it can exclusively melt metal powder, and may include at least one overlapping field region in which two or more sources can melt metal powder. In this regard, each melting beam source 412, 414, 416, 418 may generate a melting beam, respectively, that fuses particles for each slice, as defined by code 434O.

For example, in FIG. 25, melting beam source 412 is shown creating a layer of part(s) of damper element 210 using melting beam 462 in one region, while melting beam source 414 is shown creating a layer of part(s) of damper element 210 using melting beam 462' in another region. Each melting beam source 412, 414, 416, 418 is calibrated in any now known or later developed manner. That is, each melting beam source 412, 414, 416, 418 has had its laser or electron beam's anticipated position relative to build platform 420 correlated with its actual position in order to provide an individual position correction (not shown) to ensure its individual accuracy. In one embodiment, each of plurality melting beam sources 412, 414, 416, 418 may create melting beams, e.g., 462, 462', having the same cross-sectional dimensions (e.g., shape and size in operation), power and scan speed.

Continuing with FIG. 25, an applicator (or re-coater blade) 470 may create a thin layer of raw material 472 spread out as the blank canvas from which each successive slice of the final part(s) of damper element 210 will be created. Various parts of AM printer 432 may move to accommodate the addition of each new layer, e.g., a build platform 420 may lower and/or chamber 460 and/or applicator 470 may rise after each layer. The process may use different raw materials in the form of fine-grain metal powder, a stock of which may be held in a chamber 468 accessible by applicator 470.

Processing chamber 460 is filled with an inert gas such as argon or nitrogen and controlled to reduce or eliminate oxygen. Control system 430 is configured to control a flow of a gas mixture 474 within processing chamber 460 from a source of inert gas 476. In this case, control system 430 may control a pump 480, and/or a flow valve system 482 for inert gas to control the content of gas mixture 474. Flow valve system 482 may include one or more computer controllable valves, flow sensors, temperature sensors, pressure sensors, etc., capable of precisely controlling flow of the particular gas. Pump 480 may be provided with or without valve system 482. Where pump 480 is omitted, inert gas may simply enter a conduit or manifold prior to introduction to processing chamber 460. Source of inert gas 476 may take the form of any conventional source for the material contained therein, e.g., a tank, reservoir or other source. Any sensors (not shown) required to measure gas mixture 474 may be provided. Gas mixture 474 may be filtered using a filter 486 in a conventional manner.

In operation, build platform 420 with metal powder thereon is provided within processing chamber 460, and control system 430 controls flow of gas mixture 474 within processing chamber 460 from source of inert gas 476.

Control system 430 also controls AM printer 432, and in particular, applicator 470 and melting beam sources 412, 414, 416, 418 to sequentially melt layers of metal powder on build platform 420 to generate the desired part according to embodiments of the disclosure. While a particular AM system 410 has been described herein, it is emphasized that the teachings of the disclosure are not limited to any particular additive manufacturing system or method.

Once part(s) of damper element 210 is/are formed, the parts may be installed with other parts of combustor 100 to form combustor 100. The installation may include any now known or later developed technique for installing the particular combustor components used. As noted, part(s) of damper element 210 may be additively manufactured using any now known or later developed technique. Consequently, as shown in the cross-section of FIG. 26 of any part of part(s) of damper element 210 (e.g., tube 220, control member 260, etc.) includes a plurality of parallel metal layers 400 metallurgically bonded throughout an entire height thereof. Where, perhaps after operation or testing, a different or more precise damping volume is desired for a particular damping element 210, the control member 260 thereof can be replaced with a different sized and/or shaped control member 260, which may be additively manufactured as described herein, to achieve the desired damping volume.

Embodiments of the disclosure provide various technical and commercial advantages, examples of which are discussed herein. The damper element(s) of the Helmholtz damper system can be precisely adjusted to the exact frequency requiring damping that may not be initially known and may be broadband. The Helmholtz damper system allows minor and/or incremental adjustments of the damping volume, allowing for one or more precise frequencies to be targeted. The removable style of parts of the Helmholtz damper systems allow them to be taken on and off between use and/or tests without having to print entirely new resonators and without having to change a cross-sectional area of the damper elements.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately" or "about," as applied to a particular value of a range, applies to both end values and, unless otherwise dependent on the precision of the instrument measuring the value, may indicate+/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiments were chosen and described in order to best explain the principles of the disclosure and the practical application of the technology and to enable others of ordinary skill in the art to understand the disclosure for contemplating various modifications to the present embodiments, which may be suited to the particular use contemplated. 7

What is claimed is:

1. A Helmholtz damper system for a combustor of a gas turbine system, the Helmholtz damper system comprising:

at least one damper element in a cap assembly of the combustor, each damper element including:

a tube configured to be positioned in a hollow mount in a cap assembly of the combustor, wherein the hollow mount has a mount aft end in fluid communication with a combustion chamber of the combustor and a mount forward end opposing the mount aft end, wherein the tube has a hollow body having an aft end having a first perforated member in fluid communication with the combustion chamber, a forward end opposite the aft end, and a volume between the aft end and the forward end; and a damping volume control member coupled to the tube and having a second perforated member positioned to selectively define a damping volume from the volume of the tube, the damping volume defined between the second perforated member and the aft end of the hollow body of the tube, wherein the damping volume controls a frequency dampened by the respective damper element, wherein the damping volume control member includes a tubular insert configured to be positioned in the forward end of the tube to define the damping volume by reducing the volume of the tube and to increase a damping frequency of the respective damper element, wherein the second perforated member is disposed between the forward and aft ends of the tube.

2. The Helmholtz damper system of claim 1, wherein the tube has a perforated divider member between the aft end and the forward end dividing the damping volume into a forward damping volume between the second perforated member of the damping volume control member and the perforated divider member and an aft damping volume between the perforated divider member and the first perforated member of the tube.

3. The Helmholtz damper system of claim 1, wherein at least a portion of the tubular insert and at least a portion of the forward end of the tube have mating threaded surfaces, wherein the tubular insert is threadedly connected in at least the forward end of the tube.

4. The Helmholtz damper system of claim 1, wherein the damping volume control member includes an externally threaded surface configured to threadedly connect in an internally threaded surface in the tube.

5. The Helmholtz damper system of claim 4, wherein the forward end of the tube is aft of the forward end of the hollow mount.

6. The Helmholtz damper system of claim 1, further comprising a damping weight positioned in the aft end of the tube.

7. The Helmholtz damper system of claim 1, wherein the second perforated member of the damping volume control member fluidly couples the damping volume and an air plenum defined forward of the cap assembly.

8. The Helmholtz damper system of claim 1, wherein the tube includes an external positioning member between the aft end and the forward end thereof, the external positioning member interacting with the forward end of the hollow mount to position the tube relative to the hollow mount.

9. The Helmholtz damper system of claim 1, further comprising a plurality of cooling passages defined at least partially longitudinally in the tube, each cooling passage having an inlet in fluid communication with an air plenum defined forward of the cap assembly and an outlet in fluid communication with the combustion chamber.

10. The Helmholtz damper system of claim 9, wherein at least one of the plurality of cooling passages includes a length extending radially inward toward a center of the tube, and wherein the tubular insert includes a recess in an exterior surface thereof to receive the length of the at least one of the plurality of cooling passages.

11. The Helmholtz damper system of claim 9, wherein the outlet of each cooling passage is directed radially outwardly from the tube.

12. The Helmholtz damper system of claim 1, wherein the damping volume control member is additively manufactured.

13. The Helmholtz damper system of claim 1, wherein the damping volume control member is removably fastened to at least the tube with at least one of a threaded fastener, a threaded joint, a weld, a twist-lock mechanism, or a pinned connection.

14. The Helmholtz damper system of claim 1, wherein the tube is removably fastened to the hollow mount with at least one of a threaded fastener, a threaded joint, a weld, a twist-lock mechanism, or a pinned connection.

15. A fuel nozzle assembly including the Helmholtz damper system of claim 1, wherein the cap assembly includes a plurality of premixing tubes positioned adjacent the hollow mount of the at least one damper element.

16. A combustor including the fuel nozzle assembly of claim 15 and the combustion chamber downstream of the fuel nozzle assembly.

17. A Helmholtz damper system for a combustor of a gas turbine system, the Helmholtz damper system comprising:

at least one damper element in a cap assembly of the combustor, each damper element including:

a tube configured to be positioned in a hollow mount in a cap assembly of the combustor, wherein the hollow mount has an aft end in fluid communication with a combustion chamber of the combustor and a forward end opposing the aft end, wherein the tube has a hollow body having an aft end in fluid communication with the combustion chamber, a forward end opposite the aft end, and a volume between the aft end and the forward end; and a damping volume control member having a tubular body coupled to and extending at least a length of the tube, the damping volume control member further having a first perforated member positioned at an aft end of the tubular body and within the tube and a second perforated member positioned forward of the first perforated member to selectively define a damping volume between the first and second perforated members, wherein the damping volume controls a frequency dampened by the respective damper element.

18. The Helmholtz damper system of claim 17, wherein the second perforated member is positioned aft of the forward end of the tube, and the damping volume is between the forward and aft ends of the tube.

19. The Helmholtz damper system of claim 17, wherein the second perforated member is positioned forward of the forward end of the tube, and the damping volume is partially between the forward and aft ends of the tube and partially forward of the forward end of the tube.

20. A fuel nozzle assembly including the Helmholtz damper system of claim 17, wherein the cap assembly includes a plurality of premixing tubes positioned adjacent the hollow mount of the at least one damper element.

21. A combustor including the fuel nozzle assembly of claim 20, and the combustion chamber downstream of the fuel nozzle assembly.

22. A Helmholtz damper system for a combustor of a gas turbine system, the Helmholtz damper system comprising:

at least one damper element in a cap assembly of the combustor, each damper element including:

a tube configured to be positioned in a hollow mount in the cap assembly of the combustor, wherein the hollow mount has a mount aft end in fluid communication with a combustion chamber of the combustor and a mount forward end opposing the mount aft end, wherein the tube has a hollow body having an aft end having a first perforated member in fluid communication with the combustion chamber, a forward end opposite the aft end, and a volume between the aft end and the forward end; and a damping volume control member coupled to the tube and having a second perforated member positioned to selectively define a damping volume from the volume of the tube, the damping volume defined between the second perforated member and the aft end of the hollow body of the tube, wherein the damping volume controls a frequency dampened by the respective damper element, wherein the damping volume control member includes a volume enlarging member configured to be positioned at the forward end of the tube to define the damping volume by increasing the volume of the tube and to decrease a damping frequency of the respective damper element, wherein the second perforated member is disposed forward of the forward end of the tube.

23. The Helmholtz damper system of claim 22, further comprising a plurality of cooling passages defined at least partially longitudinally in the tube, each cooling passage having an inlet in fluid communication with an air plenum defined forward of the cap assembly and an outlet in fluid communication with the combustion chamber.

24. The Helmholtz damper system of claim 23, wherein the first perforated member of the tube includes a plurality of cooling members extending from an inner surface toward a center of the tube at the aft end thereof, each cooling member including a portion of a respective cooling passage defined therein and the outlet of the respective cooling passage directed into the combustion chamber.

* * * * *